US008343398B2

(12) United States Patent
Khatchikian

(10) Patent No.: US 8,343,398 B2
(45) Date of Patent: Jan. 1, 2013

(54) PANELS AND A METHOD OF MAKING

(76) Inventor: Khatchik Chris Khatchikian, Burbank, CA (US)

( * ) Notice: Subject to any disclaimer, the term of this patent is extended or adjusted under 35 U.S.C. 154(b) by 0 days.

(21) Appl. No.: 12/895,704

(22) Filed: Sep. 30, 2010

(65) Prior Publication Data

US 2011/0011032 A1 Jan. 20, 2011

Related U.S. Application Data

(62) Division of application No. 11/881,858, filed on Jul. 30, 2007.

(51) Int. Cl.

| | |
|---|---|
| ***E04B 1/00*** | (2006.01) |
| ***E04C 1/00*** | (2006.01) |
| ***B29C 65/00*** | (2006.01) |
| ***B32B 37/00*** | (2006.01) |

(52) U.S. Cl. ..... 264/46.5; 52/309.7; 52/745.19; 264/261

(58) Field of Classification Search ..... 52/742.1, 52/742.13, 745.19, 309.4, 309.7, 309.11; 264/46.5, 261

See application file for complete search history.

(56) References Cited

U.S. PATENT DOCUMENTS

| | | | | |
|---|---|---|---|---|
| 2,950,575 A | | 8/1960 | August | |
| 2,997,770 A | | 8/1961 | Beltz | |
| 3,305,991 A | * | 2/1967 | Weismann | 52/309.11 |
| 3,555,131 A | * | 1/1971 | Weismann | 264/46.7 |
| 3,879,908 A | | 4/1975 | Weismann et al. | |
| 4,104,842 A | * | 8/1978 | Rockstead et al. | 52/649.1 |
| 4,125,981 A | | 11/1978 | MacLeod | |
| 4,139,588 A | * | 2/1979 | Clem | 264/232 |
| 4,226,067 A | | 10/1980 | Artzer | |
| 4,291,732 A | | 9/1981 | Artzer | |
| 4,297,820 A | * | 11/1981 | Artzer | 52/309.11 |
| 4,336,676 A | * | 6/1982 | Artzer | 52/309.7 |
| 4,340,802 A | | 7/1982 | Artzer | |
| 4,530,191 A | | 7/1985 | Boisbluche | |
| 4,559,752 A | | 12/1985 | Kieffer | |
| 4,597,813 A | | 7/1986 | Hipkins | |
| 4,614,013 A | * | 9/1986 | Stevenson | 29/897.34 |

(Continued)

FOREIGN PATENT DOCUMENTS

GB 613911 1/1948

(Continued)

OTHER PUBLICATIONS

The Eurasian Patent Organization Conclusion about patentable of invention, dated Aug. 14, 2011.

(Continued)

*Primary Examiner* — Joshua J Michener
*Assistant Examiner* — Andrew Triggs
(74) *Attorney, Agent, or Firm* — Christie, Parker & Hale, LLP

(57) ABSTRACT

A prefabricated modular panel, comprising a framework that includes a plurality of lattices, with a lattice of the plurality of lattices comprising a first elongated member and a second elongated member that are spaced apart and juxtapose laterally parallel, forming an axial length of the lattice. Further included is a third member substantially transversally oriented at an angle along the axial length of the lattice, with the third member coupling the first elongated member with the second elongated member to form the lattice, with the plurality of lattices forming the framework. The plurality of lattices are coupled with one another in parallel by a solidified filler material forming a single piece, unitary modular panel.

23 Claims, 21 Drawing Sheets

U.S. PATENT DOCUMENTS

| | | | | |
|---|---|---|---|---|
| 4,781,009 | A * | 11/1988 | Jonsson et al. | 52/790.1 |
| 4,903,446 | A | 2/1990 | Richards et al. | |
| 5,057,546 | A * | 10/1991 | Sudan | 521/107 |
| 5,058,345 | A * | 10/1991 | Martinez | 52/309.11 |
| 5,398,470 | A * | 3/1995 | Ritter et al. | 52/309.11 |
| 5,487,248 | A * | 1/1996 | Artzer | 52/309.12 |
| 5,501,055 | A | 3/1996 | Storch | |
| 5,561,958 | A | 10/1996 | Clement et al. | |
| 5,685,124 | A | 11/1997 | Jandl | |
| 6,076,315 | A | 6/2000 | Kondo | |
| 6,148,586 | A | 11/2000 | Jandl | |
| 6,185,890 | B1 * | 2/2001 | Ritter | 52/309.11 |
| 6,226,942 | B1 * | 5/2001 | Bonin | 52/309.12 |
| 6,272,805 | B1 * | 8/2001 | Ritter et al. | 52/309.11 |
| 6,314,704 | B1 | 11/2001 | Bryant | |
| 6,412,243 | B1 | 7/2002 | Sutelan | |
| 6,434,890 | B1 | 8/2002 | Konnerth | |
| 6,526,710 | B1 | 3/2003 | Killen | |
| 6,622,444 | B2 * | 9/2003 | Zarate Sanchez et al. | 52/309.11 |
| 6,644,535 | B2 | 11/2003 | Wallach et al. | |
| 6,701,683 | B2 * | 3/2004 | Messenger et al. | 52/309.11 |
| 6,705,055 | B2 * | 3/2004 | Ritter et al. | 52/309.11 |
| 6,740,381 | B2 | 5/2004 | Day et al. | |
| 6,898,908 | B2 * | 5/2005 | Messenger et al. | 52/268 |
| 7,067,588 | B2 * | 6/2006 | Ritter et al. | 525/268 |
| 7,127,865 | B2 | 10/2006 | Douglas | |
| 7,143,559 | B1 * | 12/2006 | Ritter | 52/309.7 |
| 7,162,845 | B2 | 1/2007 | Messiqua | |
| 7,288,326 | B2 | 10/2007 | Elzey et al. | |
| 7,393,577 | B2 | 7/2008 | Day et al. | |
| 7,954,291 | B2 | 6/2011 | Cretti | |
| 2001/0010140 | A1 * | 8/2001 | Ritter et al. | 52/649.1 |
| 2003/0029107 | A1 * | 2/2003 | Ritter et al. | 52/309.11 |
| 2005/0064145 | A1 * | 3/2005 | Hoie et al. | 428/167 |
| 2006/0179748 | A1 | 8/2006 | Schmidt | |
| 2007/0066693 | A1 | 3/2007 | Bres et al. | |
| 2008/0155919 | A1 * | 7/2008 | Keshishian et al. | 52/309.11 |
| 2008/0184663 | A1 | 8/2008 | Martirossyan et al. | |
| 2009/0031661 | A1 | 2/2009 | Khatchikian | |

FOREIGN PATENT DOCUMENTS

| | | | |
|---|---|---|---|
| SU | 1182134 | A1 | 9/1985 |

OTHER PUBLICATIONS

PCT/US2008/008638 International Search Report and Written Opinion, May 2, 2007.

Bergandi Machinery Eco-Panel Structural Insulated Reinforced Concrete Panel System, web page http://www.bergandi.com/ecopanel/home_pg.html?onEnterFrame=(1 of 2), Retrieved Aug. 19, 2010.

* cited by examiner

PANELS AND A METHOD OF MAKING

CROSS-REFERENCE TO RELATED APPLICATION

This application is a divisional of co-pending U.S. patent application Ser. No. 11/881,858 filed on Jul. 30, 2007, the content of which is incorporated in this disclosure by reference in its entirety.

BACKGROUND OF THE INVENTION (1) Field of the Invention

This invention relates to construction and, more particularly construction panels and a method of their manufacture and assembly.

(2) Description of Related Art

Conventional modular panels are well known and have been in use for a number of years. Reference is made to the following exemplary U.S. Patent Publications, including U.S. Pat. Nos. 6,226,942; 3,879,908; 6,314,704; and 4,597,813. Regrettably, most prior art conventional panels suffer from obvious disadvantages in that their method of construction is complex and costly. Further, the known methods of construction compel the use of additional parts that add to the overall cost of the resulting constructed panel.

In general, most conventional panels are built by constructing a frame of the panel using complex methodologies, which require the use of additional parts that transversely interconnect the longitudinally oriented components of the frames to make the frame a standalone unit. Completely different set of complex manufacturing techniques are then used to produce an insulation (or filler) material that will be used within the constructed frame. In addition, another set of complex manufacturing methodologies are used to combine the insulation (or filler) material with the frames, and finally, further complex methodologies are used to actually use the constructed panels for building of a structure.

Accordingly, in light of the current state of the an and the drawbacks to current panel and methodologies for panel construction and use mentioned above, a need exists for a panel and a method of manufacture and use thereof that would be simple, and that would not be labor intensive and time consuming to make and use, while providing a high structural integrity.

BRIEF SUMMARY OF THE INVENTION

One aspect of the present invention provides a prefabricated modular panel, comprising a framework that includes a plurality of lattices. A lattice of the plurality of lattices is comprised of a first elongated member and a second elongated member that are spaced apart and juxtapose laterally parallel, forming an axial length of the lattice. Further included is a third member substantially transversally oriented at an angle along the axial length of the lattice, with the third member coupling the first elongated member with the second elongated member to form the lattice, with the plurality of lattices forming the framework. The plurality of lattices are coupled with one another in parallel by a solidified filler material forming a single piece, unitary modular panel.

An optional aspect of the present invention provides a prefabricated modular panel, wherein the third member is a single piece elongated unit having a zigzag configuration that spans longitudinally along the axial length of the lattice.

Another optional aspect of the present invention provides a prefabricated modular panel, wherein the third member couples the first elongated member with the second elongated member at vertexes that form the angles in alternative directions of the zigzag configuration.

Still another optional aspect of the present invention provides a prefabricated modular panel, wherein the third member is comprised of a plurality of single pieces that are transversally oriented along the axial length of the lattice; with each single piece having a first extremity and a second extremity, with the first extremity jointed to the first elongated member and the second extremity jointed to the second elongated member, with each single piece oriented substantially perpendicular to the first and second elongated members.

A further optional aspect of the present invention provides a prefabricated modular panel, wherein each of the plurality of lattices is a truss, with each truss member coupled with one another at a member extremities only, with no truss member continuous through a joint.

Yet a further optional aspect of the present invention provides a prefabricated modular panel, wherein the prefabricated modular panel includes one or more transversally oriented utility through holes aligned along an axial length of the prefabricated modular panel.

Another optional aspect of the present invention provides a prefabricated modular panel, wherein the plurality of lattices are coupled with one another by the solidified filler material formed inside a mold to form the prefabricated modular panel.

Yet another optional aspect of the present invention provides a prefabricated modular panel, wherein the prefabricated modular panel includes a spacing between the first elongated member and the solidified filler material and the second elongated member and the solidified filler material.

Still another optional aspect of the present invention provides a prefabricated modular panel, wherein the mold is comprised of one or more parallel channels that extend longitudinally, oriented along the axial length of the plurality of lattices, with each lattice placed within a channel of the one or more channels of the mold, with the channels allowing one of the first and second elongated members of the plurality of lattices to be secured therein the channels.

A further optional aspect of the present invention provides a prefabricated modular panel, wherein the filler material is comprised of Expandable Polystyrene (EPS) material.

Another aspect of the present invention provides a method for prefabricating modular panels, comprising juxtaposing laterally a first elongated member and a second elongated member in parallel, and coupling a third member with the first elongated member and the second elongated member, substantially transversally oriented along an axial length of the first elongated member with the second elongated member to form a lattice of the prefabricating modular panels. Thereafter, coupling one or more lattices with one another in parallel by a filler material that is solidified inside a mold to form a single piece, unitary prefabricating modular panel.

Another optional aspect of the present invention provides a method for prefabricating modular panels, wherein coupling the one or more lattices includes: pre-expanding the filler material; drying the expanded filler material; storing the dried and expanded filler material within storage facilities; placing the one or more lattices inside the mold; transferring the pre-expanded filler material into the mold; applying heat to the mold to expand the filler material, filling in void spaces within mold; cooling mold for removal of panel, and ejecting the final prefabricating modular panel.

Yet another optional aspect of the present invention provides a method for prefabricating modular panels, wherein the mold is comprised of parallel channels that extend longitudinally, oriented along an axial length of the mold, with each lattice placed within a channel of the one or more channels of the mold, with the channels allowing one of the first and second elongated members of the plurality of lattices to be secured therein the channels.

Still another optional aspect of the present invention provides a method for prefabricating modular panels, wherein pre-expanding the filler material includes soaking the filler material within an expansion substance to filler material and addition of heat to reduce density of the filler material and allow the filler material to expand.

A further optional aspect of the present invention provides a method for prefabricating modular panels, wherein the expansion substance is pentane.

Still a further optional aspect of the present invention provides a method for prefabricating modular panels, wherein drying the expanded filler material includes removing and drying the soaked and expanded filler material by application of dry air.

Another optional aspect of the present invention provides a method for prefabricating modular panels, wherein storing the dried and expanded filler material within storage facilities includes transporting the dried and expanded filler material by blowers for storage and maturing within silos.

Another aspect of the present invention provides a prefabricated modular panel used for a structure, comprising one or more prefabricated modular panels are positioned within a foundation of the structure, vertically juxtaposed and coupled with one another with wiring.

Another optional aspect of the present invention provides a prefabricated modular panel used for a structure, wherein one or more prefabricated modular panels are vertically juxtaposed within a foundation by excavating a channel with desired dimensions; modifying the prefabricated modular panel by partially removing the filler material thereof at a lower section of the prefabricated modular panel to expose the lattices; inserting the modified prefabricated modular panel with the exposed lath inside the channels; coupling the vertically juxtaposed modified prefabricated modular panel by wiring that spans a surface area of all juxtaposed panels, including inside the channels; and pouring concrete within the channels to fill the channels, with the concrete curing and coupling the modified prefabricated modular panel, forming a single piece unitary structure.

A further optional aspect of the present invention provides a prefabricated modular panel used for a structure, wherein the wiring is coupled with the first and the second elongated members of the prefabricated modular panels.

Still a further optional aspect of the present invention provides a prefabricated modular panel used for a structure, wherein the prefabricated modular panel are finally covered with external covering.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Figure 1A:
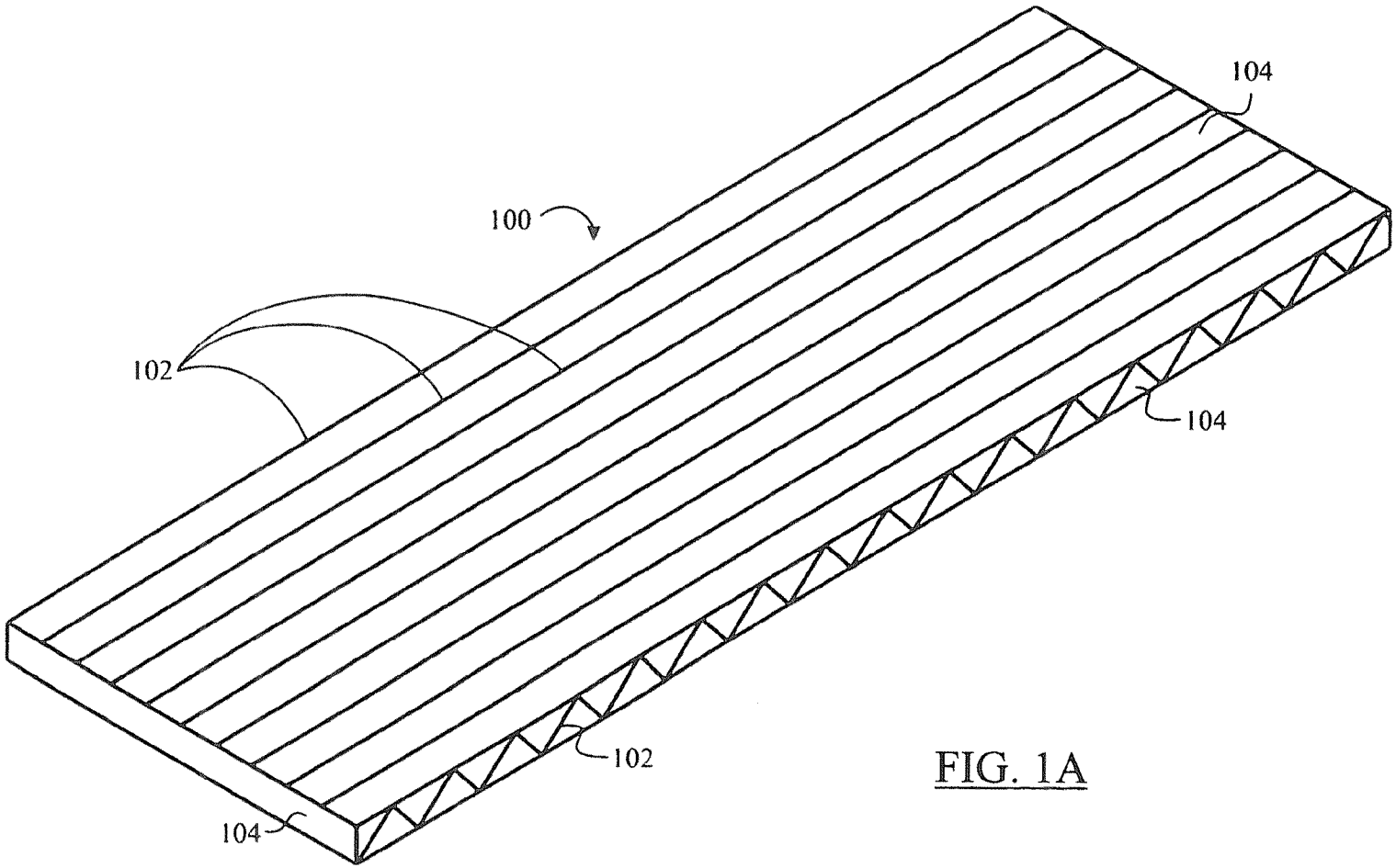
FIG. 1A is an exemplary illustration of a prefabricated modular panel in accordance with the present invention.

The present invention provides a prefabricated modular panel and a method of manufacture and use thereof that is simple and is not labor intensive and time consuming to make and use, while providing a lightweight panel with high structural integrity. FIG. 1A is an exemplary illustration of a prefabricated modular panel in accordance with the present invention. As illustrated, the present invention provides a prefabricated modular panel 100, comprising a framework 106 (FIG. 1B) that includes a plurality of lattices 102 coupled with one another in parallel by a solidified filler material 104 within a mold to form a single piece, unitary prefabricated modular panel 100.

Figure 1B:
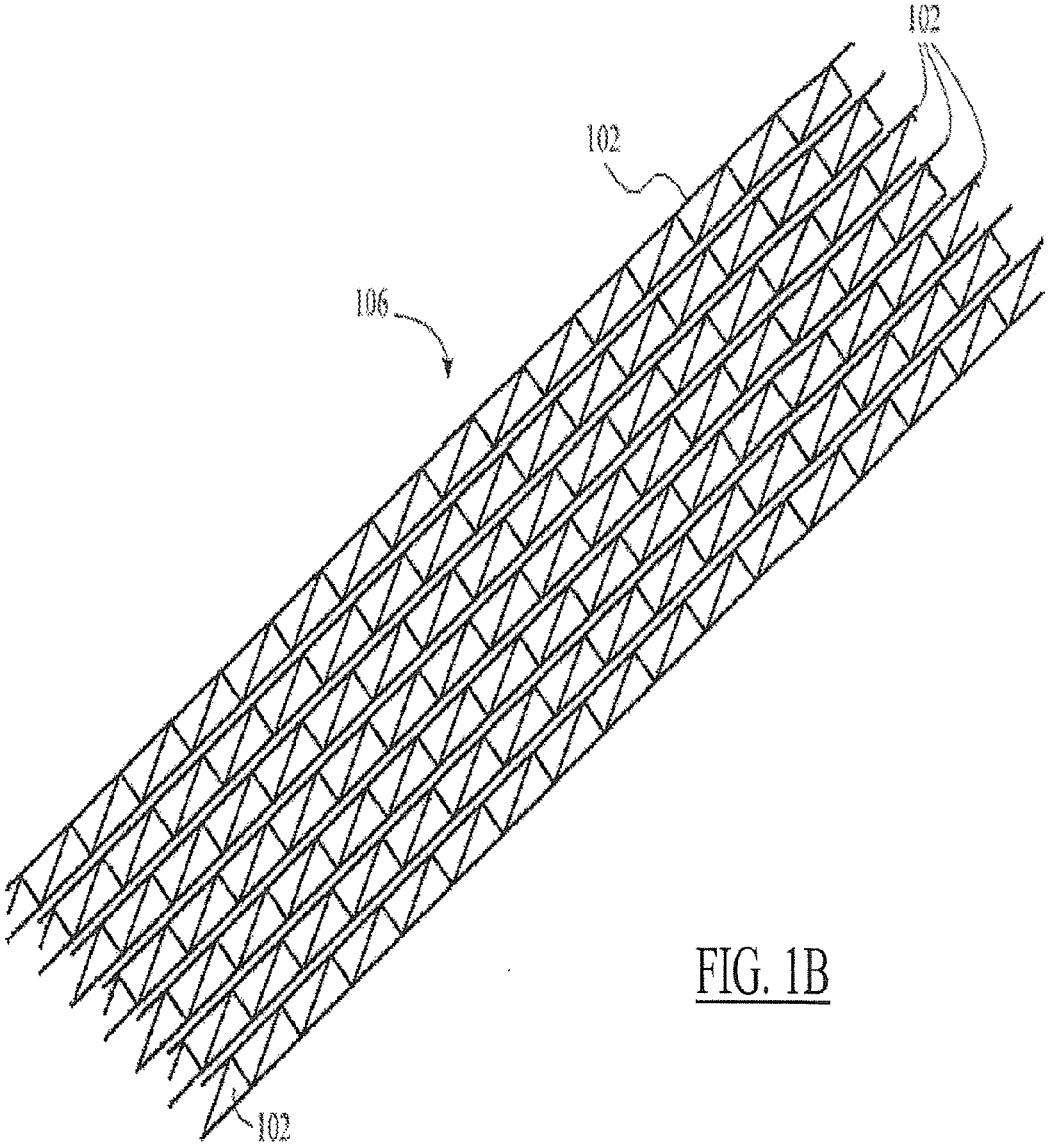
FIG. 1B is an exemplary illustration of A framework of the prefabricated modular panel illustrated in FIG. 1A in accordance with the present invention.

FIG. 1B is an exemplary illustration of the framework 106 of the prefabricated modular panel 100 in accordance with the present invention, with the filler material 104 removed. As illustrated, the framework 106 is comprised of a plurality of lattices 102 that are coupled with one another by the solidified filler material 104 (illustrated in FIG. 1A). The plurality of lattices 102 are transversely coupled with one another only by the solidified filler material 104 formed inside a mold to form the prefabricated modular panel 100.

Figure 1C:
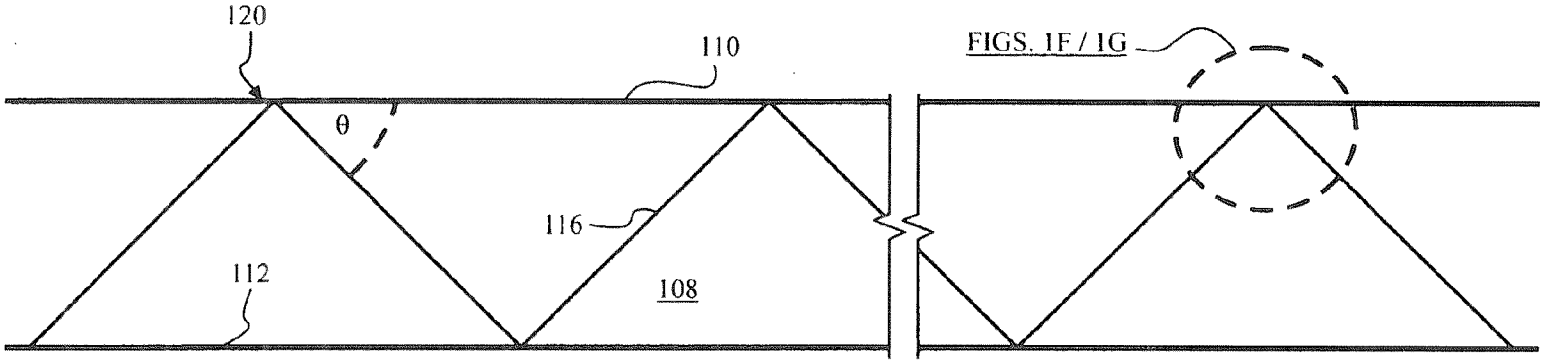
FIGS. 1C and 1D are exemplary plan view illustrations of lattices that make the framework of the prefabricated modular panel in accordance with the present invention.
Figure 1D:
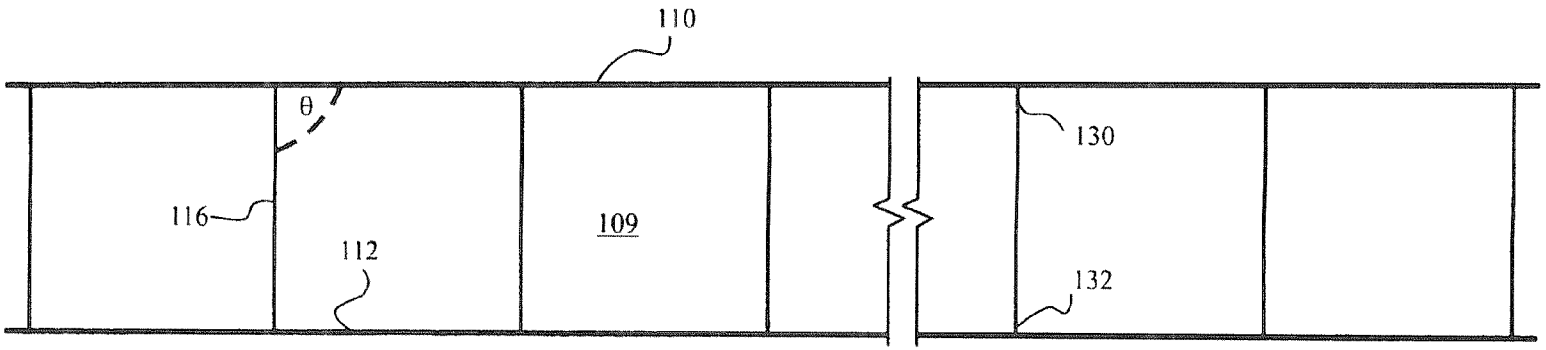

FIGS. 1C and 1D are exemplary plan view illustrations of lattices 102 that make the framework 106 of the prefabricated modular panel 100 in accordance with the present invention. As illustrated, each lattice 108 and or 109 of the plurality of lattices 102 is comprised of a first elongated member 110 and a second elongated member 112 that are spaced apart and juxtapose laterally (one on top (110) and the other in bottom (112)) in parallel, forming an axial length 114 of the lattice 108 and or 109. As further illustrated, the lattice 108 and or 109 further includes a third member 116 substantially transversally oriented at an angle θ along the axial length 114 of the lattice 108 and or 109. The third member 116 couples the first elongated member 110 with the second elongated member 112 to form the lattice 108 and or 109, with the plurality of lattices 102 forming the framework 106.

As illustrated in FIG. 1C, the third member 116 may comprise of a single piece elongated unit having a zigzag configuration that spans longitudinally along the axial length 114 of the lattice 108. The third member 116 couples the first elongated member 110 with the second elongated member 112 at vertexes 120 that form the angles θ (less than 90°) in alternative directions of the zigzag configuration. FIGS. 1F and 1G are exemplary illustrations of methods for coupling the third zigzag member 116 to the first and second elongated members 110 and 112. As best illustrated in FIG. 1F, one specific, non-limiting exemplary technique for manufacture of lattice 108 is to place the respective first and second elongated members 110 and 112 in parallel in relation to one another and place the third member 116 on top of the respective first and second elongated members 110 and 112, and weld them. Another method is to simply weld the apex of the vertex of every angle of the zigzag configuration of the third member 116 to the surface (facing inside the lattice) of the respective first and second elongated members 110 and 112, as illustrated in FIG. 1G.

As illustrated in FIG. 1D, the third member 116 is comprised of a plurality of single pieces that are transversally oriented along the axial length 114 of the lattice 109. Each single piece 116 having a first extremity 130 and a second extremity 132, with the first extremity 130 jointed to the first elongated member 110 and the second extremity 132 jointed to the second elongated member 112, with each single piece 116 oriented substantially perpendicular to the respective first and second elongated members 110 and 112.

Of course, each of the plurality of lattices 102 may also be comprised of a true truss, where all members of the truss are individual pieces, with each truss member coupled with one another at a member extremities only, with no truss member continuous through a joint. It should be noted that it is for the sake of brevity, clarity, convenience, and to avoid duplication that only two types of lattices 108 and 109 are illustrated, and three types described. Nonetheless, as illustrated in FIGS. 1A and 1B, the plurality of lattices 102 are juxtapose laterally in parallel and are coupled with one another by a solidified filler material 104 (within a mold) forming a single piece, unitary prefabricated modular panel 100.

In forming the framework 106 of the prefabricated modular panel 100, any combination of lattices may be juxtaposed laterally in parallel with one another. For example, a framework 106 may comprise of a plurality of lattices 102, with each individual lattice of the plurality of lattices 102 comprised of ladder lattices 109. The framework 106 may also comprise of a plurality of lattices 102, with each individual lattice of the plurality of lattices 102 comprised of triangular lattices 108. A combination of different types of individual lattices may also be used to form the framework 106. That is, both triangular lattices 108 and ladder lattices 109 may be used in combination to form the framework 106. The ladder type lattices 109 provide structural strength that counters forces that are perpendicular to the horizontal plane of the prefabricated modular panel 100, which is particularly beneficial for prefabricated modular panels 100 that are used in horizontal orientation in relation to the ground. The triangular or zigzag type lattices 108 provide structural strength that is somewhat similar to those of trusses, but simpler and easier to manufacture than a truss or a ladder lattice.

Figure 1E:
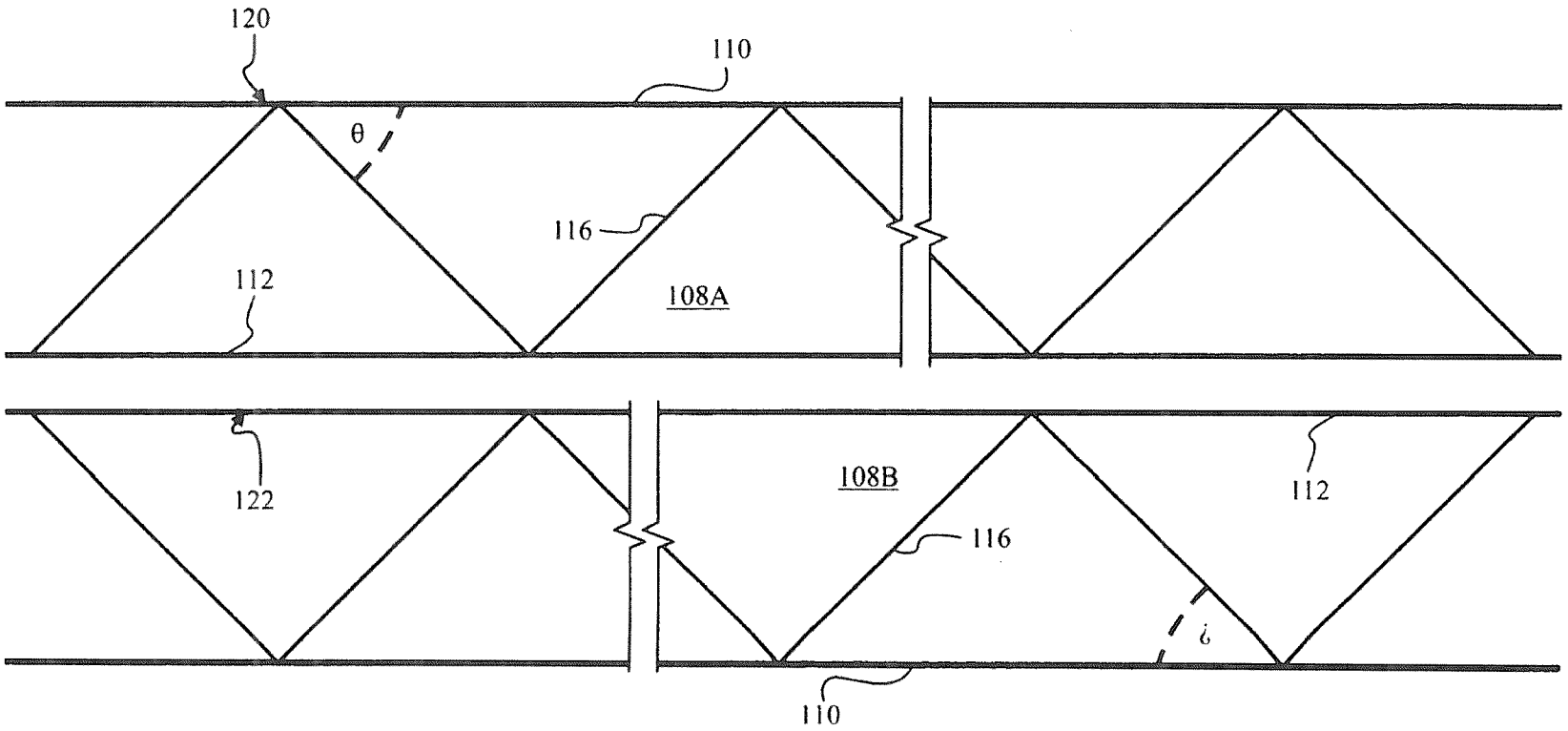
FIG. 1E is an exemplary illustration of two triangular lattices placed laterally in opposite orientation.
Figure 1G:
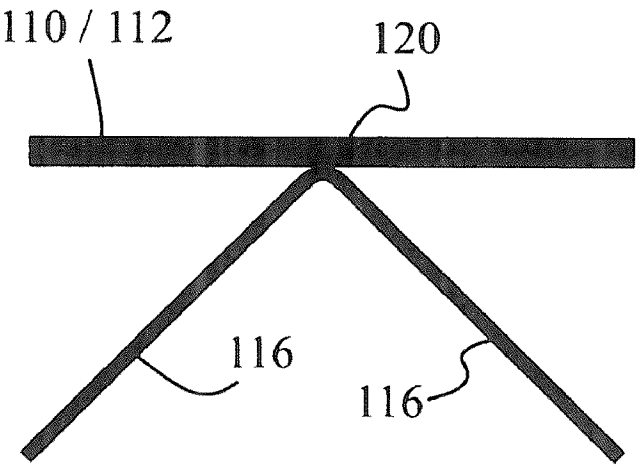
FIGS. 1F and 1G are exemplary illustrations of methods for coupling a third zigzag member to the first and second elongated members in accordance with the present invention.
Figure 1F:
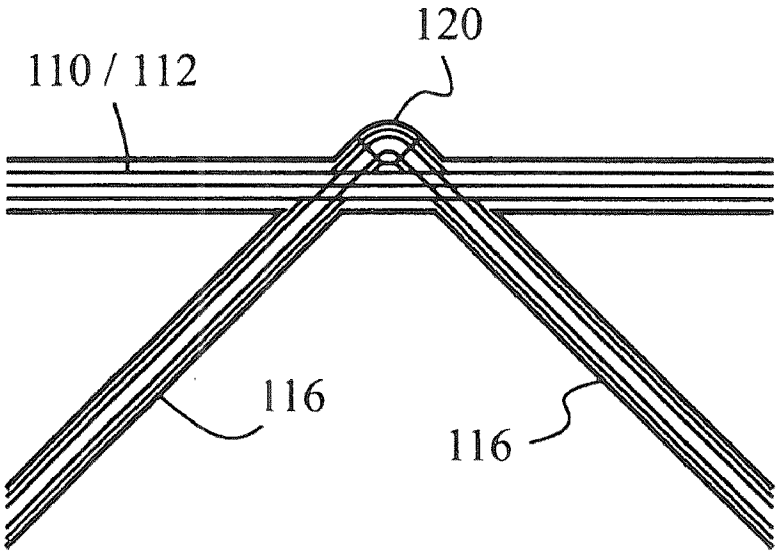

As further illustrated in FIG. 1E, triangular lattices 108 may be juxtaposed laterally in parallel in upside down orientation to form the framework 106. That is, the vertices 120 of lattice 108A is placed parallel adjacent the bases 122 of the other lattice 108B, the combination of which can be optionally used with ladder lattices 109, all of which provide added structural strength. Accordingly, any combination and permutations of lattices 108, 109 or any other types (e.g., true trusses) or in any orientations may be juxtaposed laterally in parallel with one another to form the framework 106 for added structural strength and integrity.

Figure 2A:
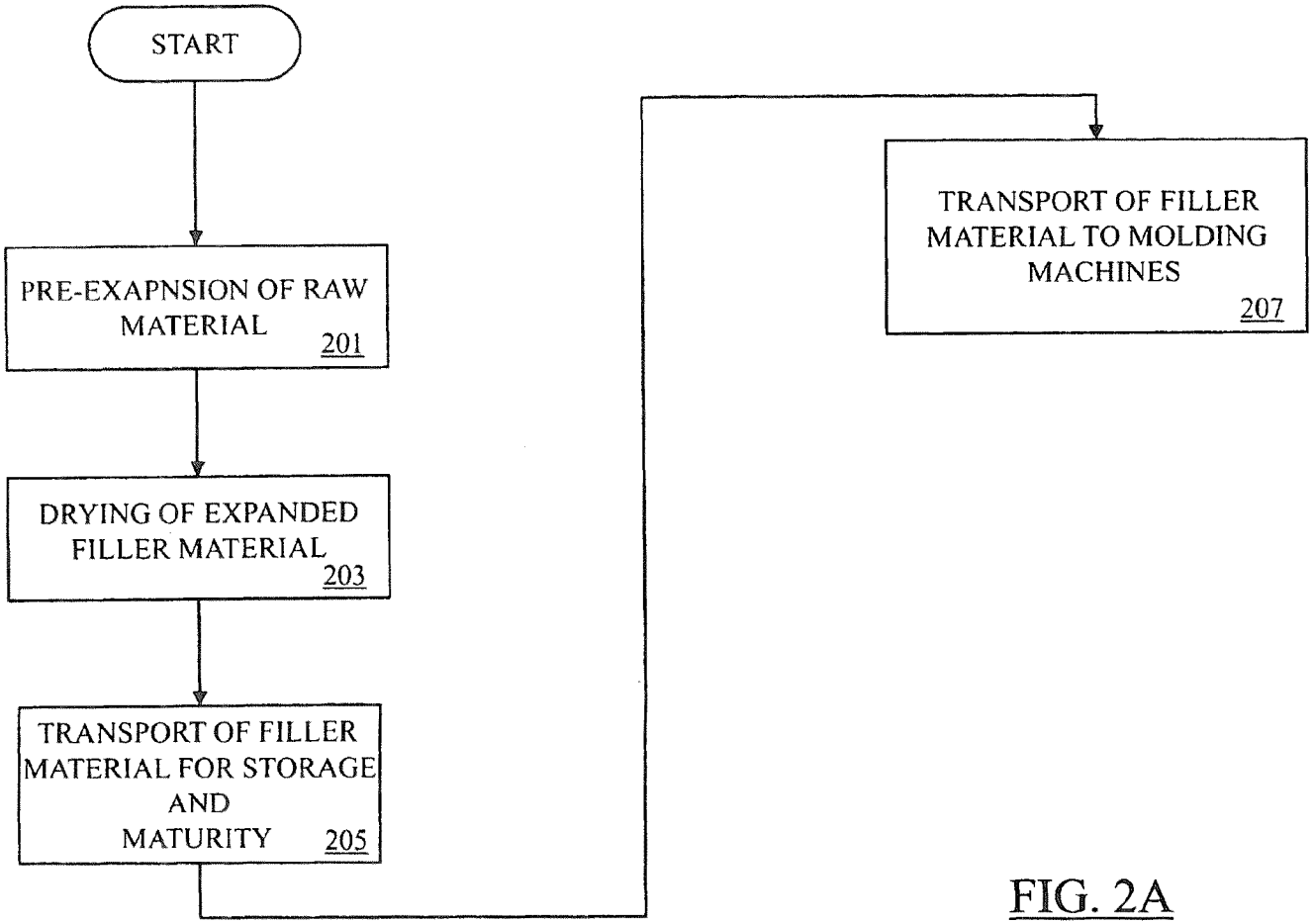
FIG. 2A is an exemplary flow chart illustration of a manufacturing process of a filler material of the prefabricated modular panel in accordance with the present invention.

FIG. 2A is an exemplary flow chart illustration of a manufacturing process of a filler material of the prefabricated modular panel in accordance with the present invention. In general, a preferred, but non-limiting and exemplary filler material used with the present invention is Expandable Polystyrene (EPS). EPS and the production of EPS are well known, and do not form the inventive part of the present invention. Accordingly, any method or manufacturing process that is used to produce EPS will work with the present invention.

Figure 2B:
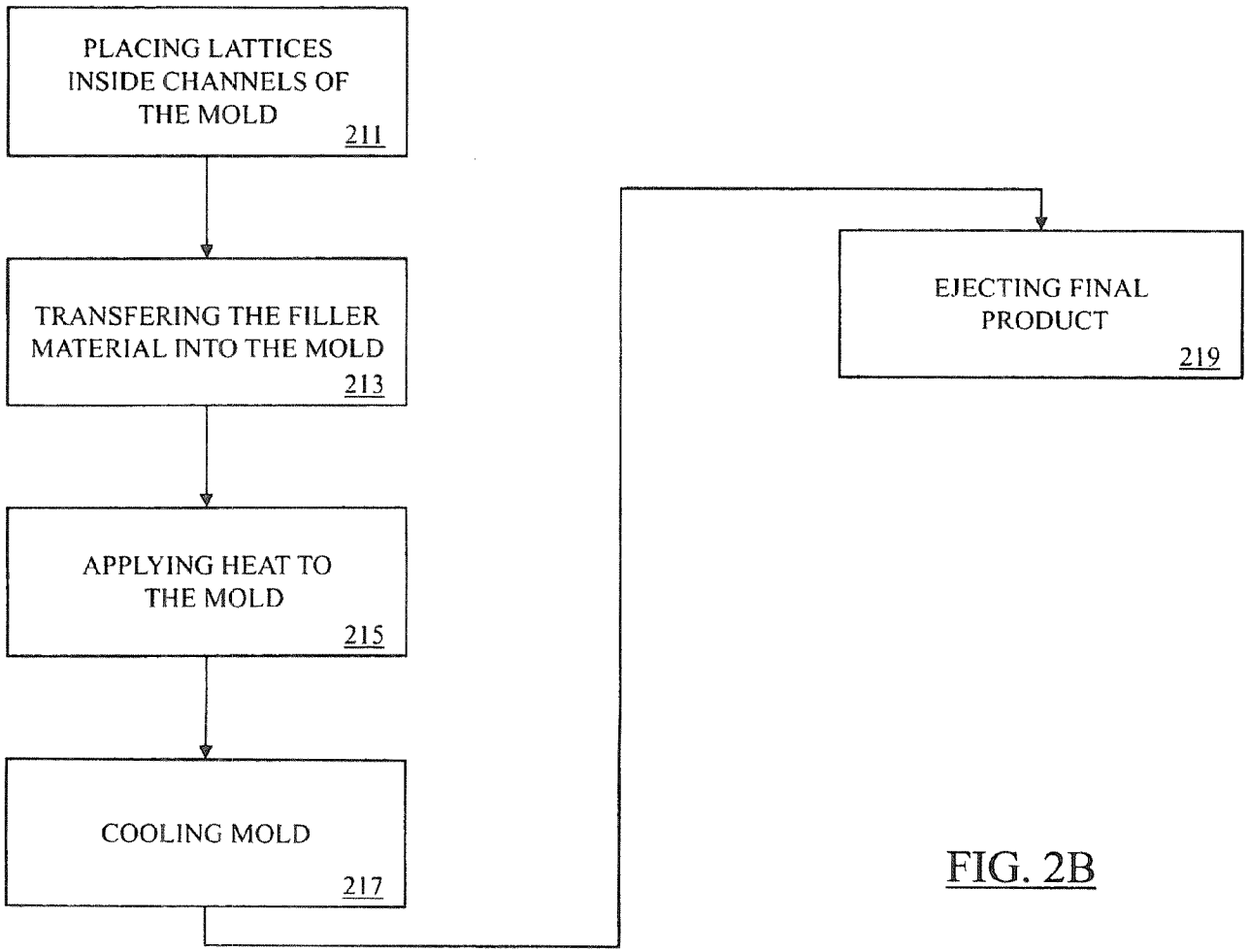
FIG. 2B is an exemplary flow chart illustration of manufacturing process of molding the prefabricated modular panel using the filler material in accordance with the present invention.
Figure 2C:
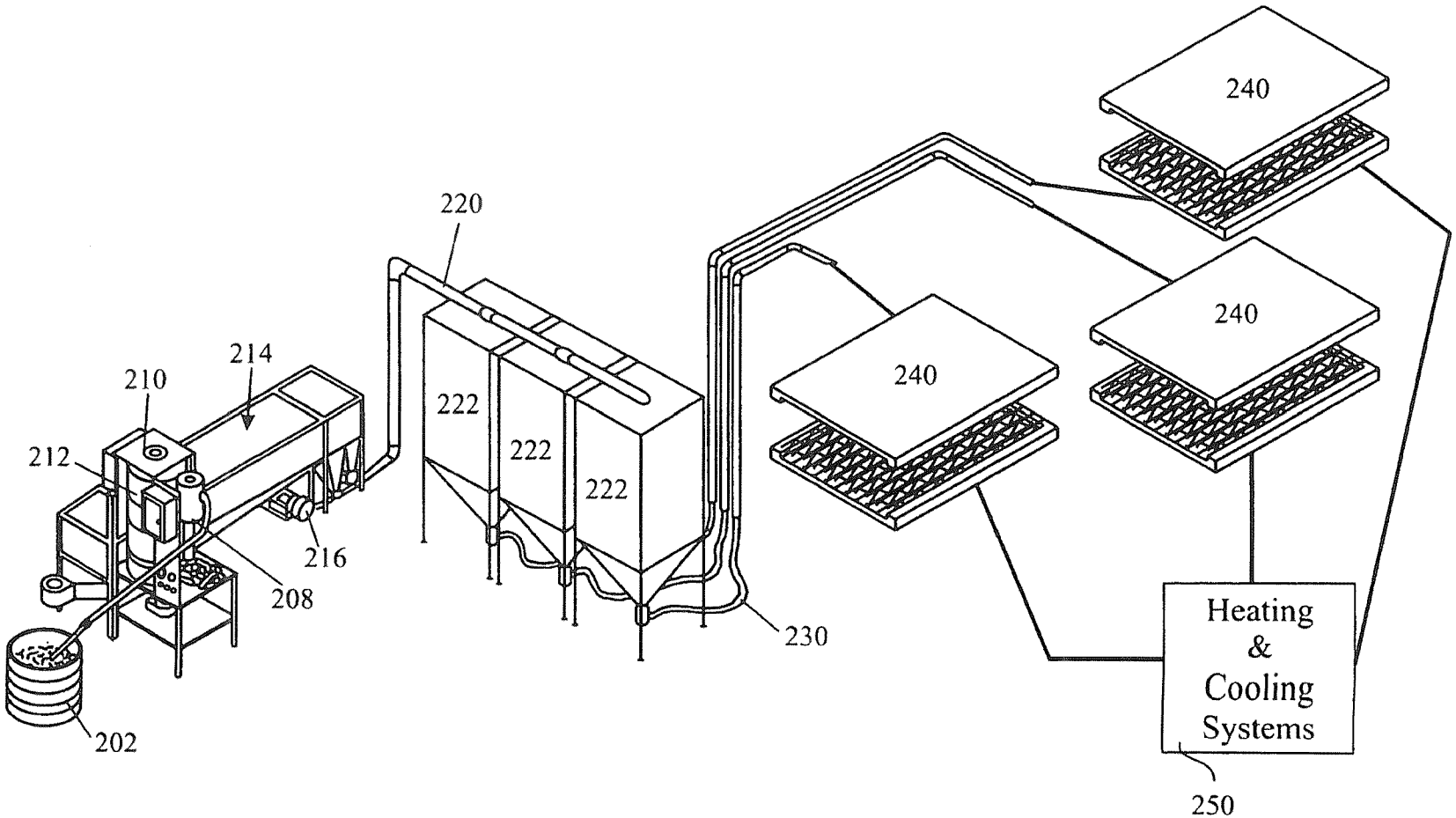
FIG. 2C is an exemplary schematic illustration of a manufacturing equipment used to produce the filler material.

FIG. 2C is an exemplary schematic illustration of one exemplary method for production of EPS and its use as the filler material of the prefabricated modular panel. In general, the raw material (raw EPS) used comes in the form of beads and hence, needs to be expanded before its use as the filler material 104 of the present invention. According, as part of the production of EPS, a pre-expansion process as the illustrated functional acts 201 (of FIG. 2A) is needed before its use. Pre-expanding the raw EPS beads includes reducing the density of the beads 202 by soaking the beads 202 within an expansion substance such as pentane, and the addition of heat. In particular, the raw material (raw EPS beads) 202 is delivered by a transport system 208 into a chamber 212 of a pre-expander unit 210 that includes pentane wherein the beads are soaked, and heat is applied therein the chamber 212 to expand and reduce the density of the beads 202. The exemplary process is a continuous type, which means that there is a continuous flow of fresh beads 202 into the expander unit 210. As the beads 202 are expanded, they simply overflow into the dryer 214 (similar to overflow of pop corn when it is heated and expanded). As illustrated in the functional act 203, the still wet expanded EPS is moved into a dryer, where the growing or expansion process stops because no more heat is applied to the now expanded beads. The still wet expanded material is moved into the dryer fluid bed 214, where a blower 216 applies dry air to the wet material to dry the wet EPS. As indicated in the functional act 205, the now dried and expanded EPS is moved into storage units or silos 222 for storage and maturity via a pipe work 220. In general, the capacity of the production of EPS should always be higher than the actual use of material by molding machines 240, and further, certain manufacturers of EPS require a minimum maturity of 24 hours before the use of EPS. Accordingly, silos offer a capacity higher then the daily maximum demand. As further illustrated in the functional act 207, molding machines 240 of the present invention are then coupled to the silos 222 via connecting hoses 230, where EPS is transported therein and used.

Figure 3A:
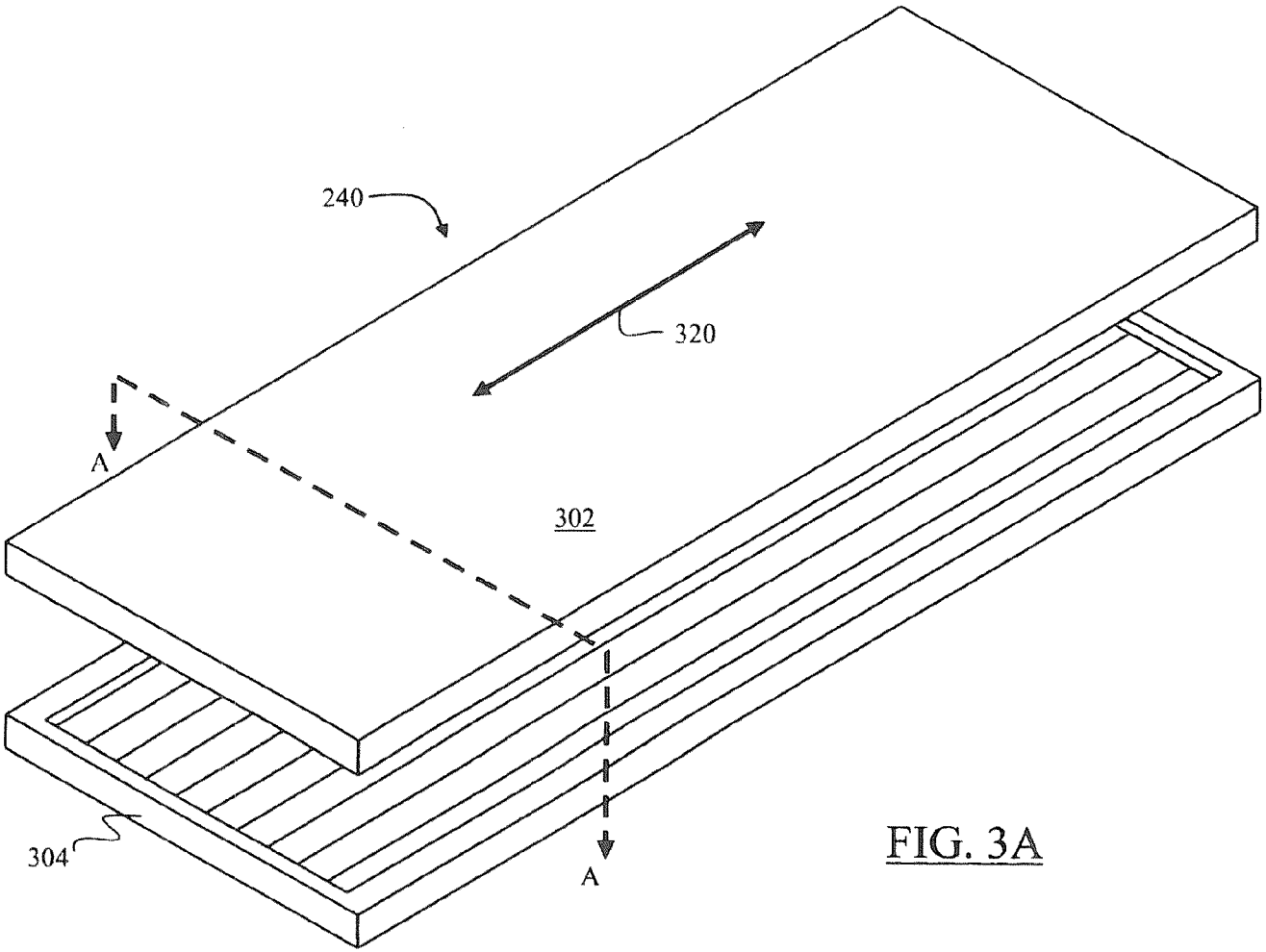
FIG. 3A is an exemplary top-view perspective illustration of a mold in accordance with the present invention.
Figure 3B:
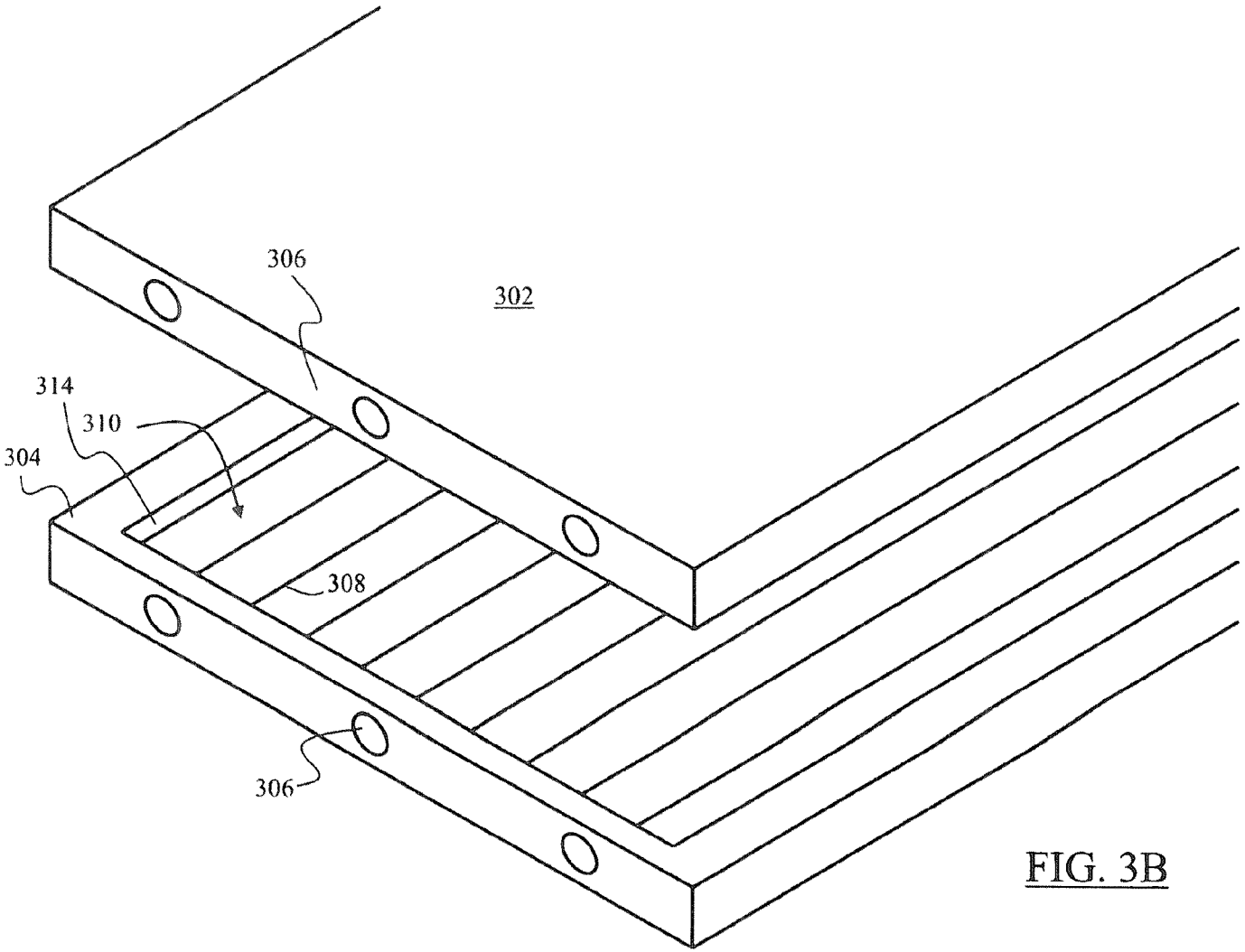
FIG. 3B is an enlarged close-up view of the same.
Figure 3C:
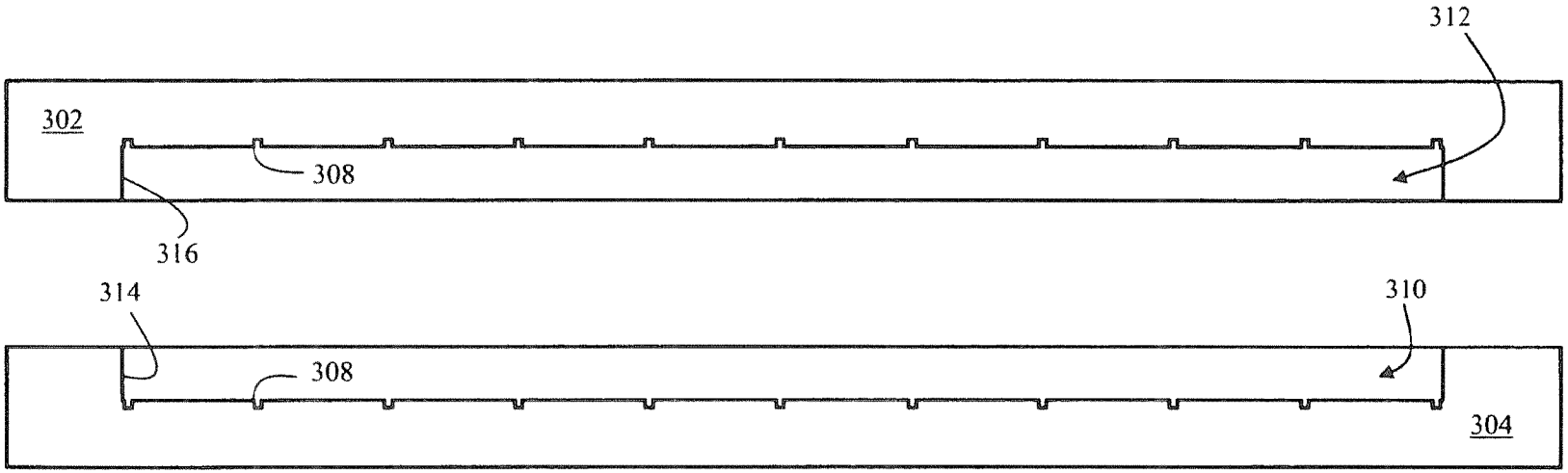
FIG. 3C is an exemplary front-cross-sectional view of the mold in the direction A-A illustrated in FIG. 3A.
Figure 3D:
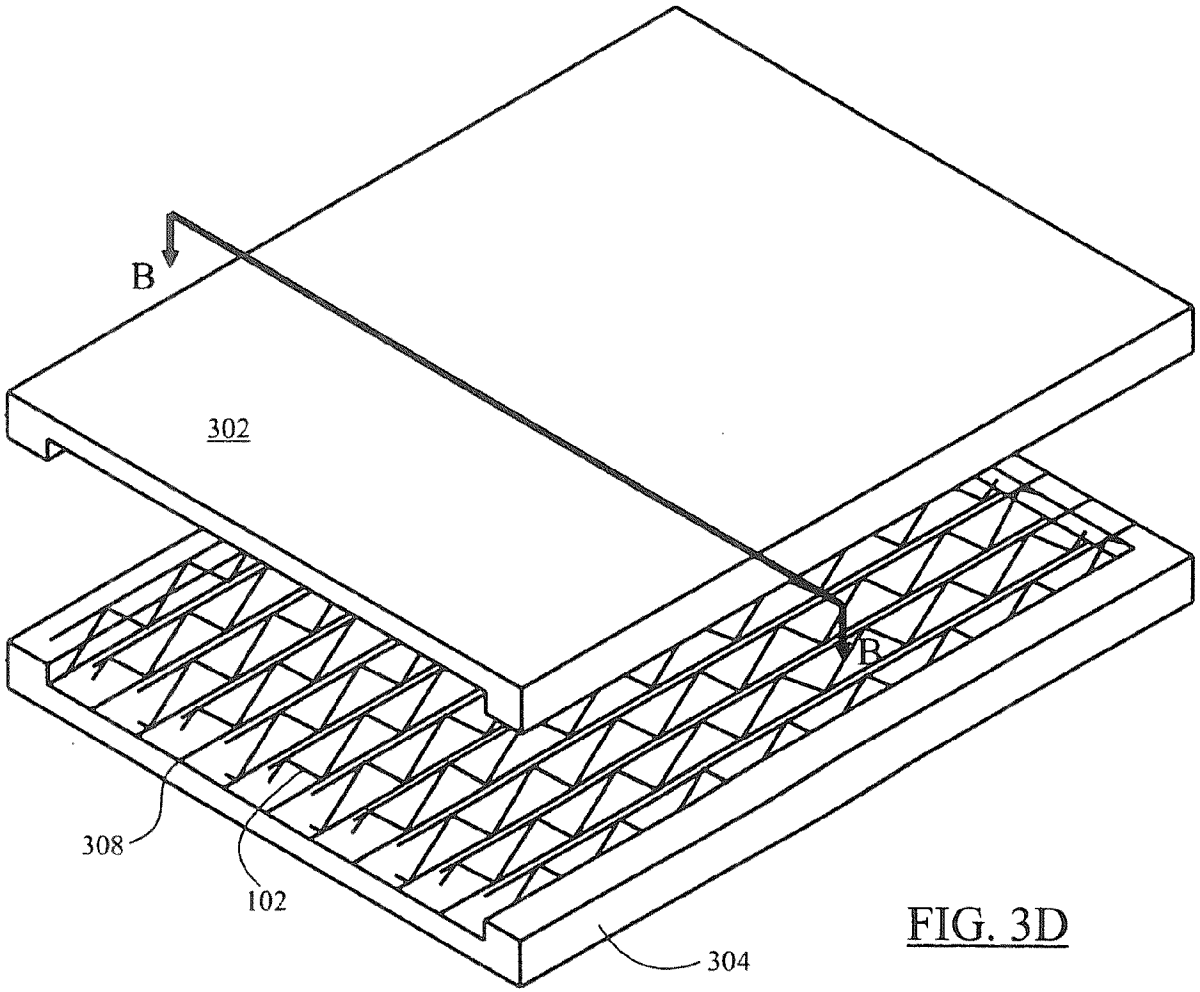
FIG. 3D is an exemplary top-view perspective illustration of the mold illustrated in FIG. 3A, with the placement of lattices within the mold in accordance with the present invention.
Figure 3E:
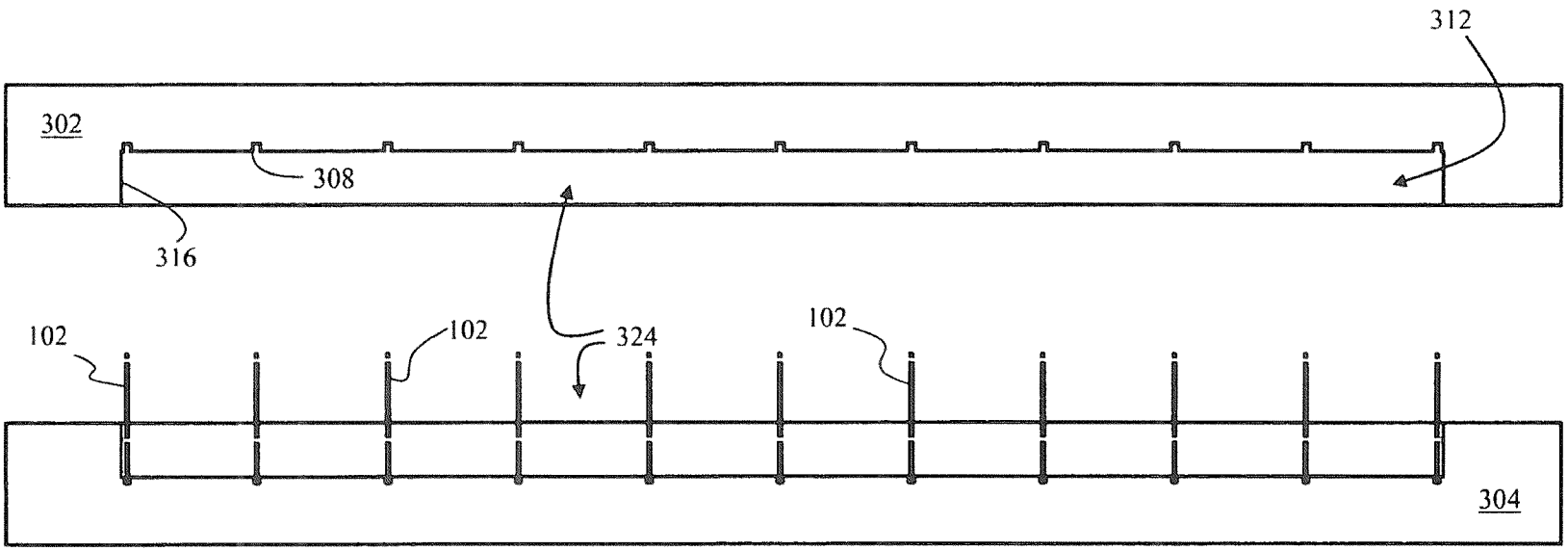
FIG. 3E is an exemplary front-cross-sectional view of the mold in the direction B-B illustrated in FIG. 3D.

FIG. 2B is an exemplary flow chart illustration of manufacturing process of molding the prefabricated modular panel using the filler material in accordance with the present invention. As illustrated at functional act 211, the lattices 102 are placed inside the channels of molds 240. FIGS. 3A to 3E are various exemplary views of the molds 240 of the present invention. FIG. 3A is an exemplary top-view perspective illustration of a mold in accordance with the present invention, and FIG. 3B is an enlarged close-up view of the same. FIG. 3C is an exemplary front-cross-sectional view in the direction A-A illustrated in FIG. 3A. FIG. 3D is an exemplary top-view perspective illustration of the mold illustrated in FIG. 3A, with the placement of lattices within the mold in accordance with the present invention. FIG. 3E is an exemplary front-cross-sectional view in the direction B-B illustrated in FIG. 3D.

As illustrated in FIGS. 3A to 3C, the mold 240 is comprised of a chamber with a top piece 302 and a bottom piece 304, with the bottom piece 302 having a bottom piece cavity 310 and a top piece 302 with a top piece cavity 312. The respective bottom and top piece cavities 310 and 312 are configured to mold any size and shape prefabricated modular panel. In this exemplary instance, the mold cavities 310 and 312 are commensurately contoured for manufacture of prefabricated modular panel 100 illustrated in FIG. 1A. As illustrated, in this exemplary instance, the bottom piece cavity 310 is the mirror image of the top piece cavity 312. Both cavities have interior surrounding walls 314 and 316, configured to form the lateral sides or edges of the prefabricated modular panel 100. As further illustrated in FIGS. 3A to 3C, the mold 240 further includes one or more parallel channels 308 that extend longitudinally, oriented along the axial length 320 of the mold 240. As indicated by the functional act 211 in FIG. 2B and as best illustrated in FIG. 3D, each lattice 102 is placed within a channel 308 of the one or more channels of the mold 240, with the channels 308 allowing the respective first and second elongated members 110 and 112 of the plurality of lattices 102 to be secured upright (longitudinally parallel with ground), laterally within the channels 308. Accordingly, as best illustrated in FIG. 3E, the lattices 102 are placed in between the respective top and bottom pieces 302 and 304 of the mold 240 and housed within the channels 308, with one of the first and second elongated members 110 and 112 of the lattices 102 housed in channels 308 of the bottom piece 304 and the other member housed in the channel 308 of the top piece 302. The respective top and the bottom pieces 302 and 304 of the mold are then closed, ready for injection of the filler material. It should be noted that any type of mold may be used so long as there is means to uphold the plurality of lattices therein the mold. For example, the mold 240 may comprise of a single piece mold rather than two pieces (top and bottom), with the single piece mold having a side-opening door to allow loading of lattices 102 and unloading of the prefabricated modular panels 100.

As illustrated in FIG. 2B, at the functional act 213, the filler material (EPS) is transferred into the molds 240 by well-known mechanisms through one or more apertures 306 (the location of the apertures 306 may be varied). In general, injection of EPS inside the molds 240 fills the void spaces 324 inside the cavities 310 and 312, which are in between the lattices 102. As further illustrated in FIG. 2B, at functional act 215 heat is applied to the molds 240 by a heating and cooling system 250, where the filler material EPS is expanded and bonds (physical bonding) with the lattices to form the prefabricated modular panel 100. Although not illustrated, the mold may comprise additional apertures for the application of heat therein. As illustrated in the functional act 217, the mold 240 is then cooled by the heating and cooling system 250 and the final prefabricated modular panel 100 is ejected from the mold 240 (functional act 219) ready for use. Other methods of manufacturing prefabricated modular panels 100 in accordance with the present invention may include assembly-line type manufacturing methodology.

Figure 4A:
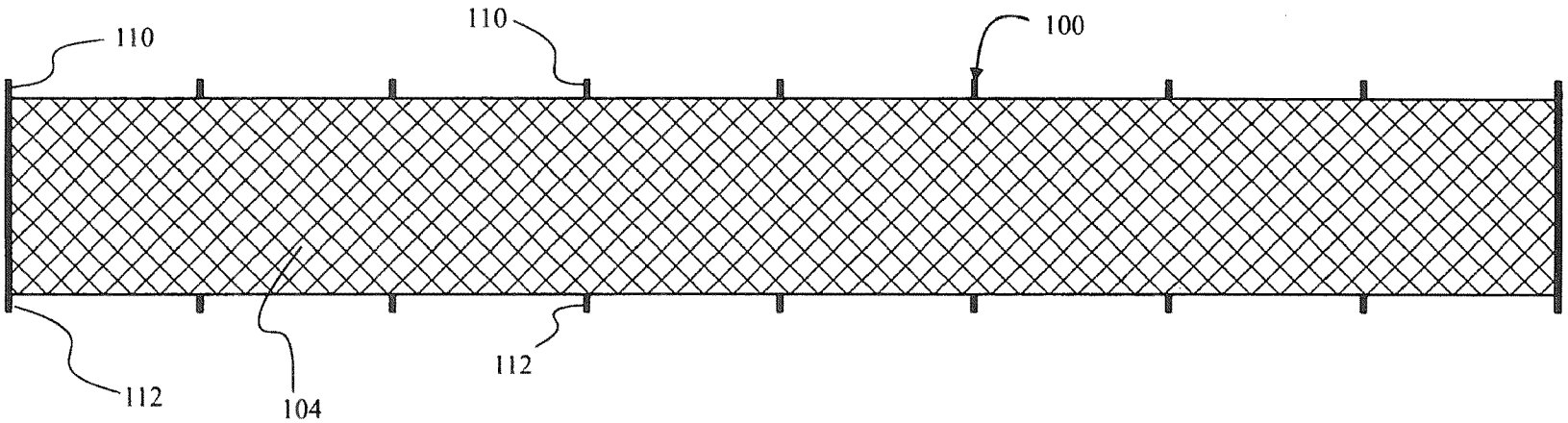
FIG. 4A is an exemplary front cross-sectional illustration of the prefabricated modular panel illustrated in FIG. 1A.
Figure 4B:
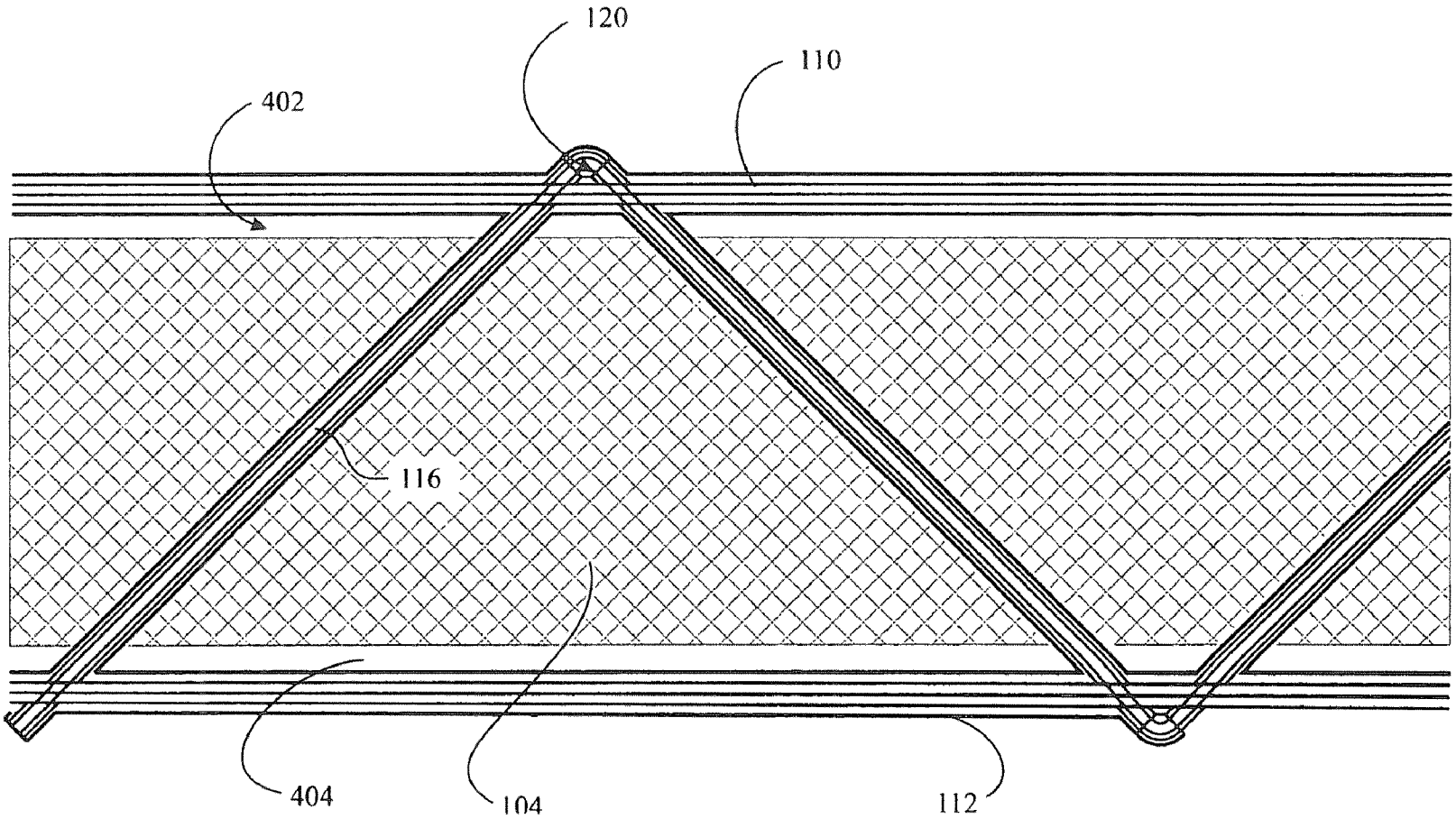
FIG. 4B is an exemplary lateral cross-sectional views of the prefabricated modular panel that uses triangular lattices in accordance with the present invention.
Figure 4C:
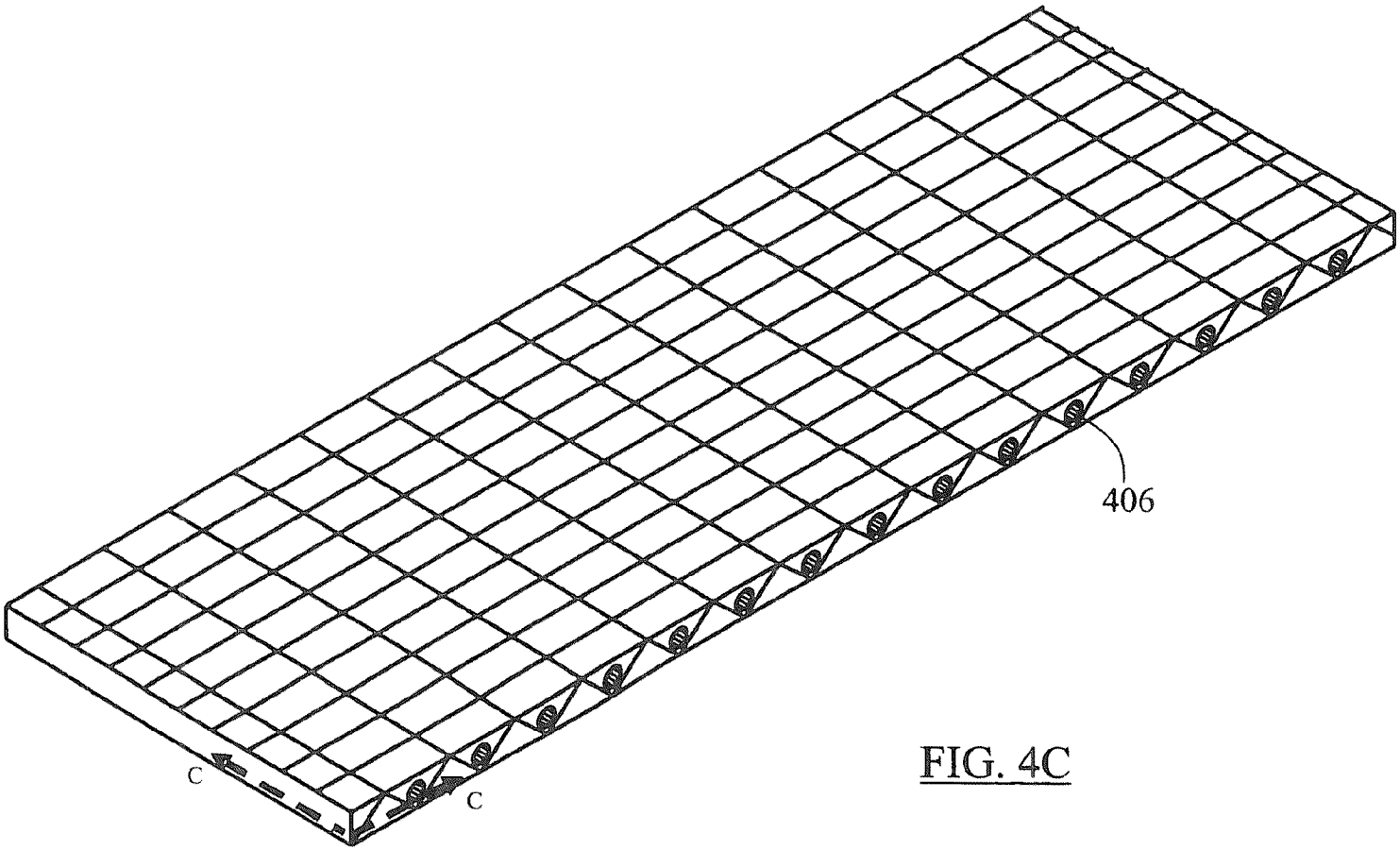
FIG. 4C is an exemplary illustration of the prefabricated modular panel illustrating one or more transversally oriented utility holes in accordance with the present invention.
Figure 4D:
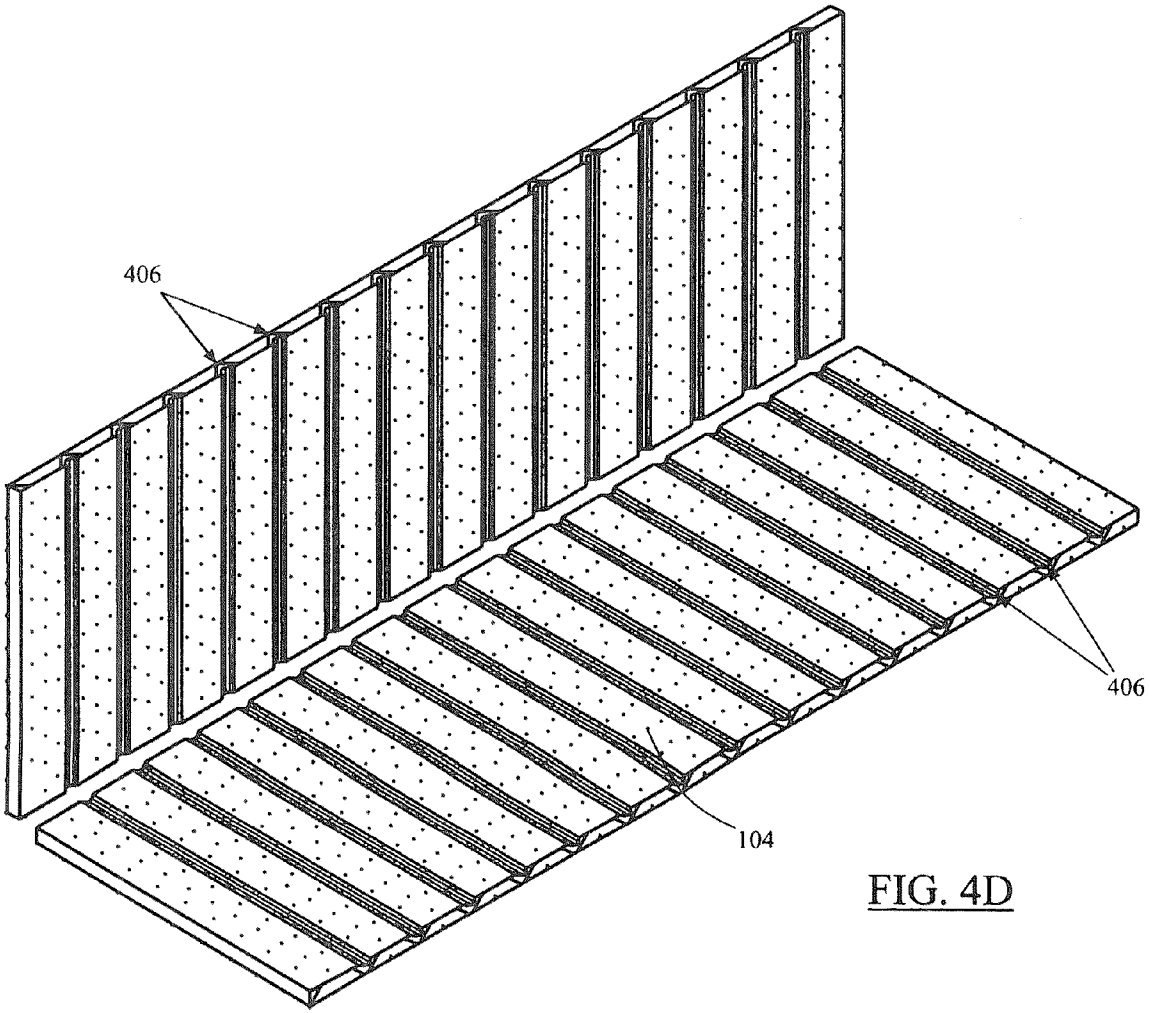
FIG. 4D is an exemplary perspective cross sectional view of the prefabricated modular panel along the lines C-C illustrated in FIG. 4C.

FIGS. 4A to 4D are various exemplary views of the finally prefabricated modular panel 100 of the present invention. FIG. 4A is an exemplary front cross-sectional illustration of the prefabricated modular panel 100 illustrated in FIG. 1A. FIG. 4B is an exemplary lateral cross-sectional views of the prefabricated modular panel 100 that uses triangular lattices. FIG. 4C is an exemplary illustration of the prefabricated modular panel 100 illustrating one or more transversally oriented utility holes. FIG. 4D is an exemplary perspective cross sectional view along the lines C-C illustrated in FIG. 4C. As illustrated, the prefabricated modular panel 100 is comprised of the framework 106 (FIG. 1B) that includes the plurality of lattices 102 coupled with one another in parallel by a solidified filler material (EPS) 104 forming a single piece, unitary prefabricated modular panel 100. As best illustrated in FIGS. 4A and 4B, the prefabricated modular panel 100 includes a spacing 402 in between the first elongated member 110 and the solidified filler material 104 and spacing 404 in between the second elongated member 112 and the solidified filler material 104. The depth of the spacing is equal to the depth of the channels 308 of the molds 240. Accordingly, as illustrated in the cross-sectional view in FIG. 4A and lateral view in FIG. 4B, the lattices 102 are not fully encapsulated by the filler material (EPS) 104 and hence, the respective first and the second elongated members 110 and 112 protrude out and are visible. As further illustrated in FIGS. 4C and 4D, the prefabricated modular panel 100 may further include one or more transversally oriented utility through holes 406 aligned along an axial length 320 of the prefabricated modular panel 100, which also reduce the overall weight of the panels 100, but can be used for housing and running utility wiring through the holes 320.

Figure 5A:
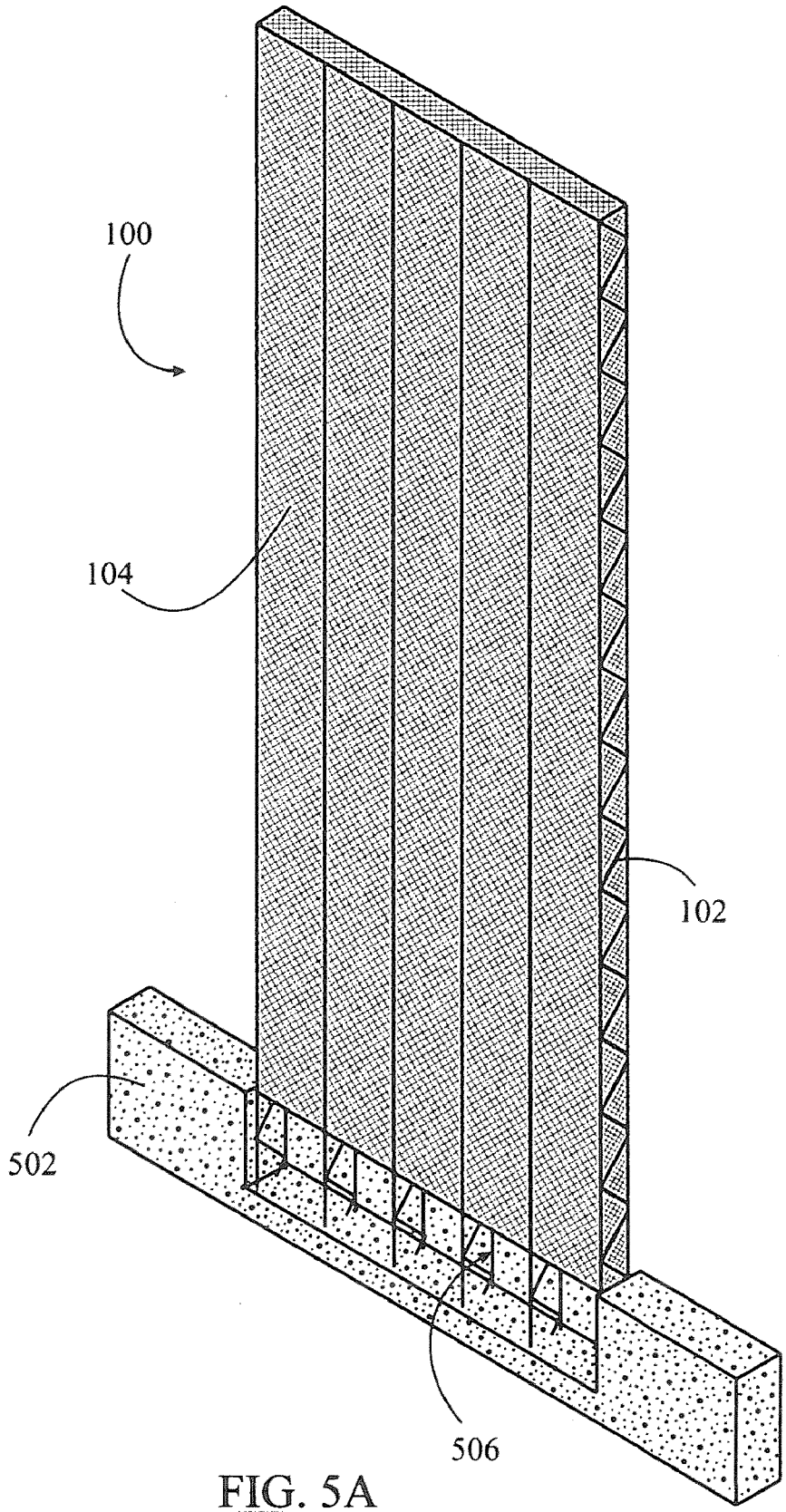
FIG. 5A is an exemplary illustration of a prefabricated modular panel used as a wall, placed within a foundation in accordance with the present invention.
Figure 5B:
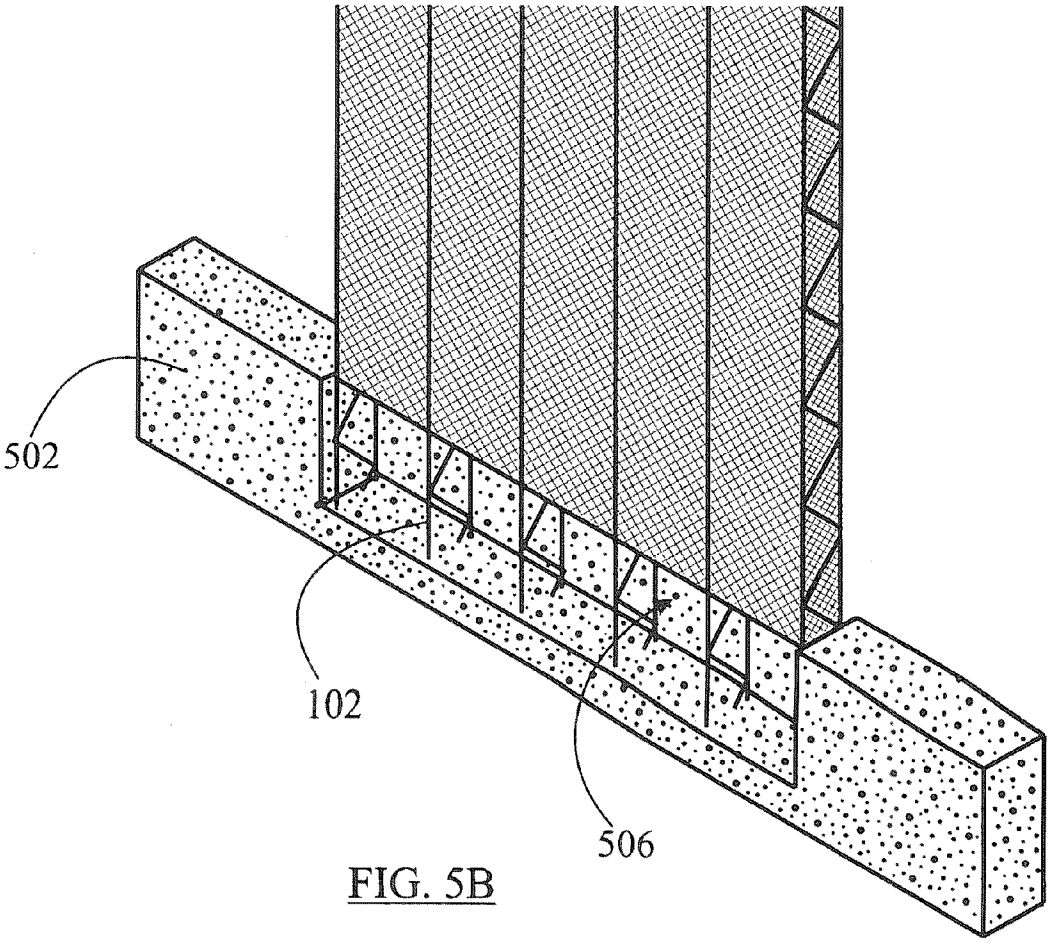
FIG. 5B is an enlarged illustration of the same.
Figure 5C:
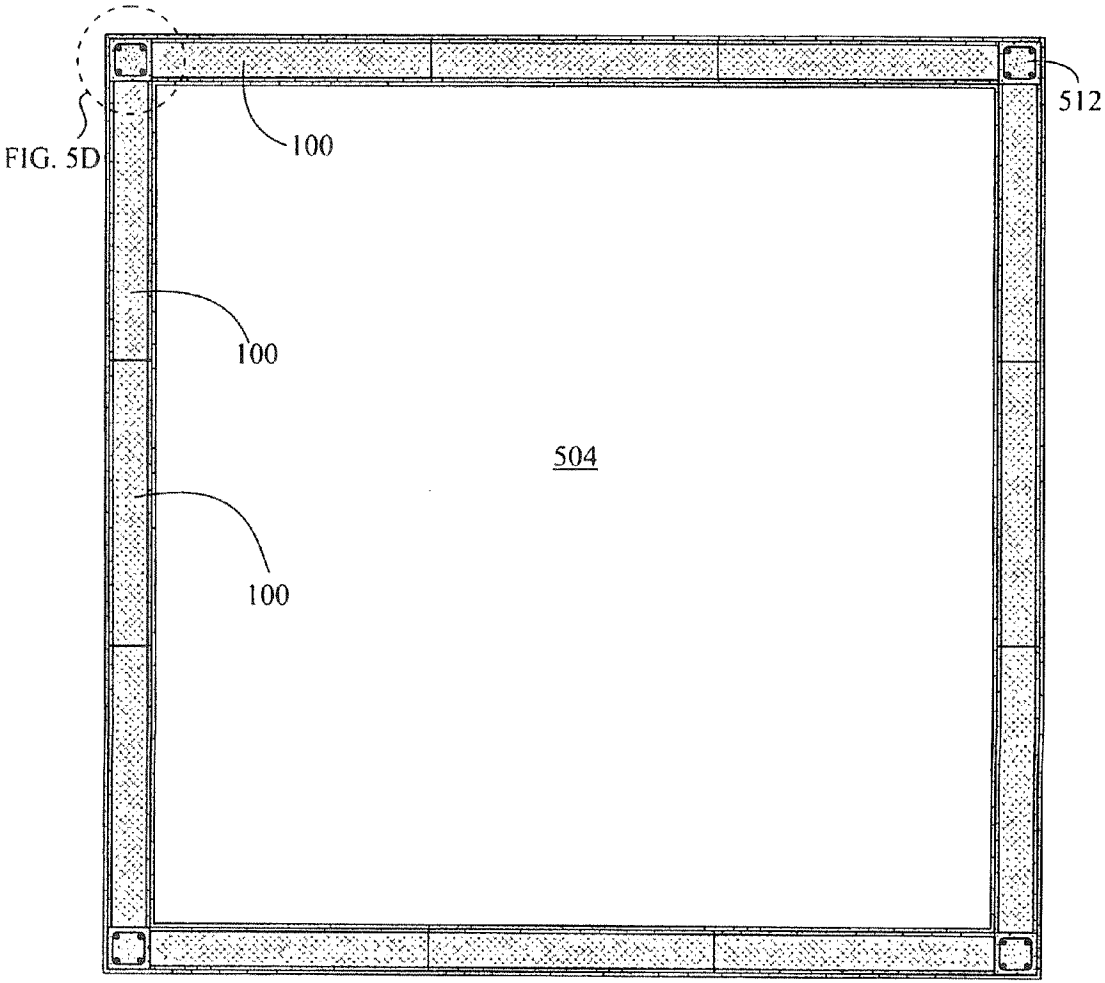
FIG. 5C is an exemplary illustration of connection of the prefabricated modular panel together to form the four corners of a housing or chamber, using beams in accordance with the present invention.
Figure 5D:
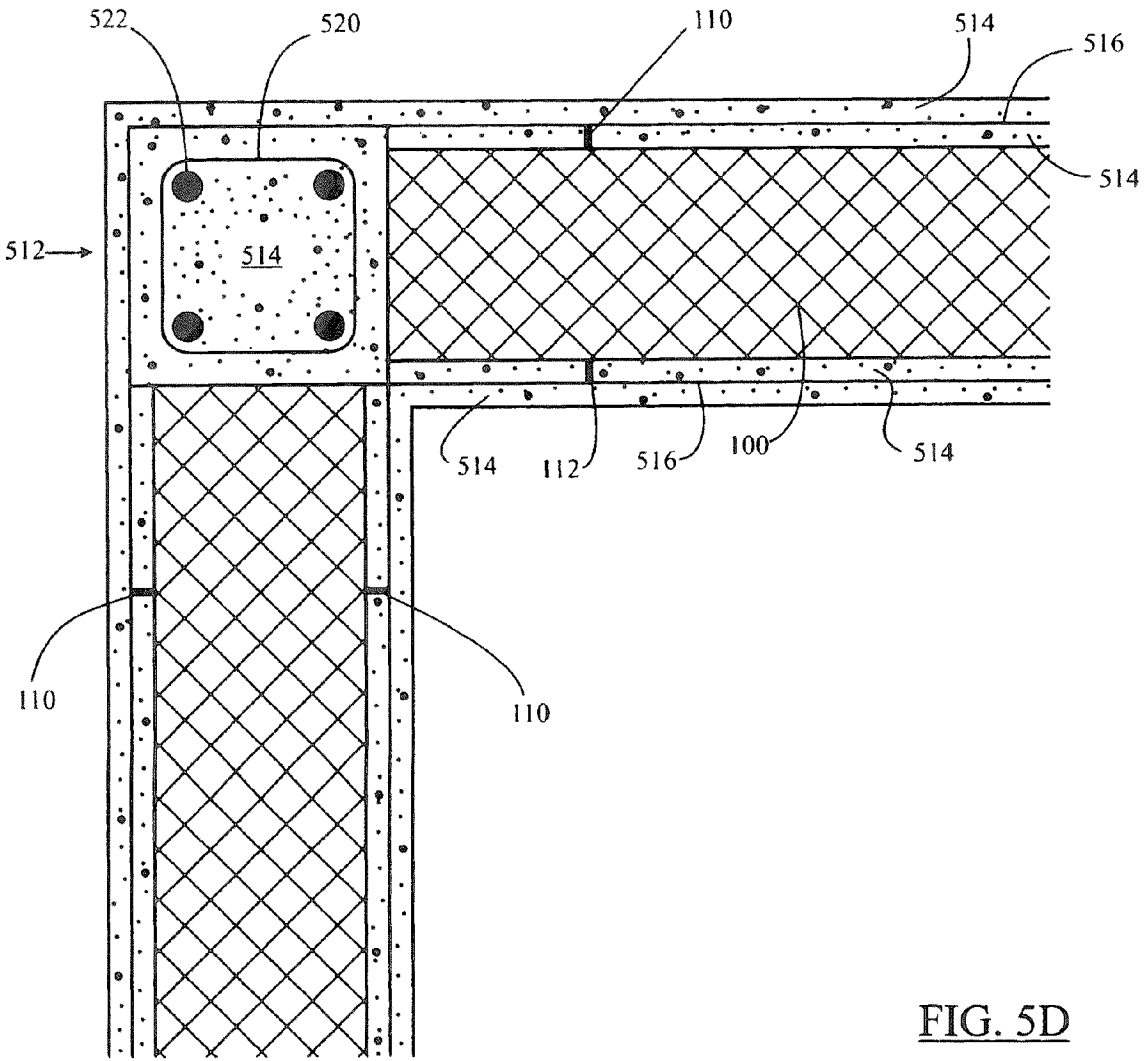
FIG. 5D is an exemplary illustration of details of one of the four corners illustrated in FIG. 5C.
Figure 2A:
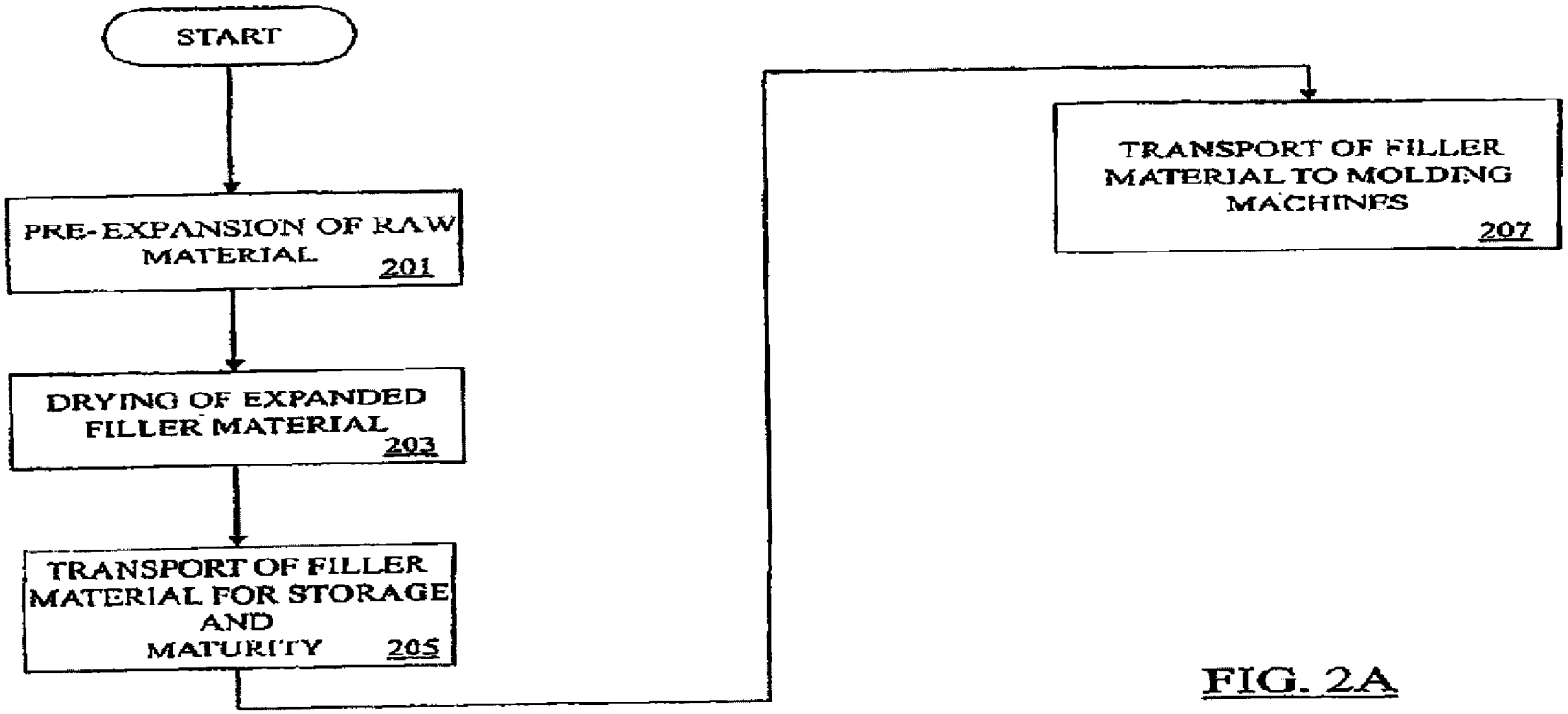
Figure 2B:
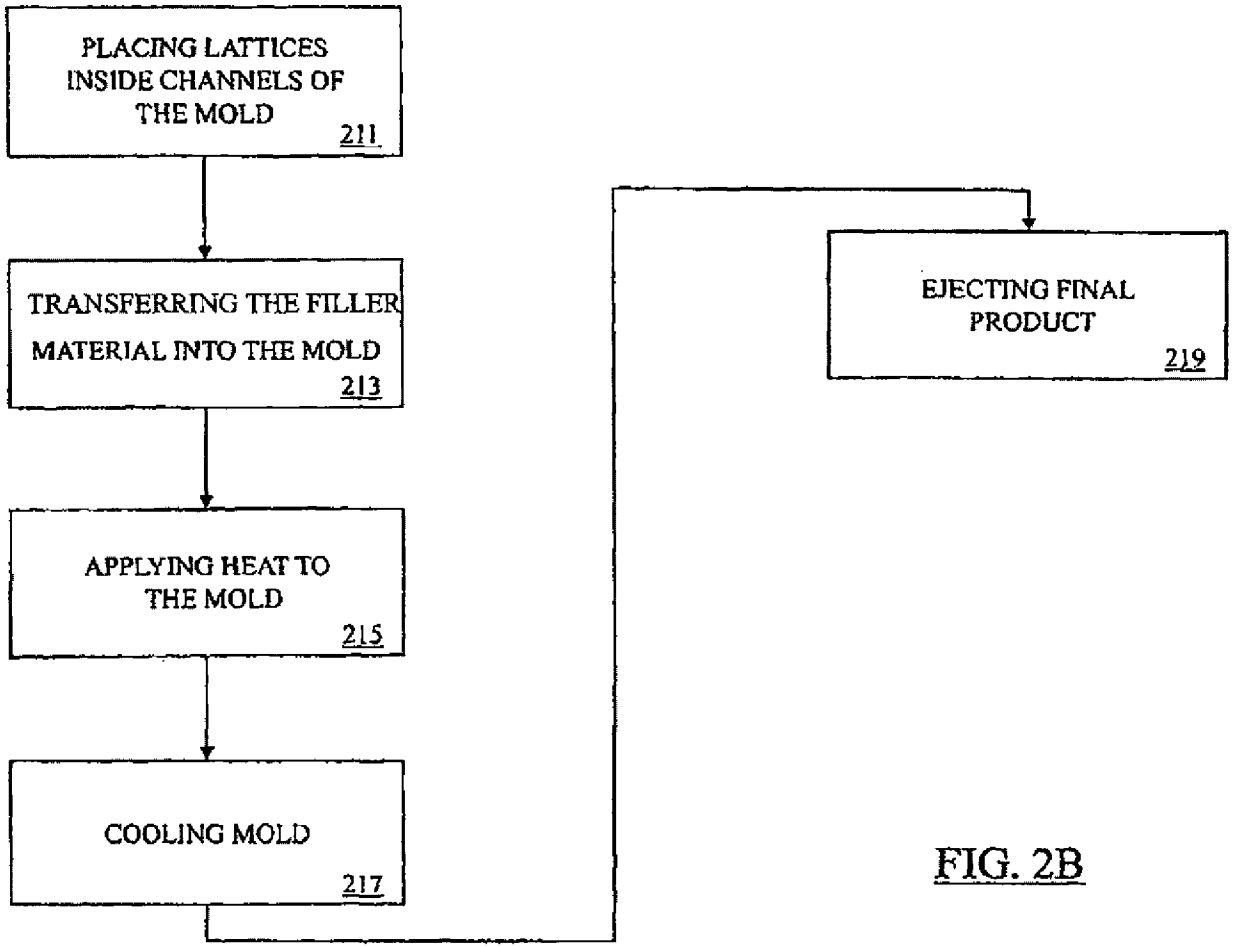

FIGS. 5A to 5D are various view of the prefabricated modular panel used for a building a structure in accordance with the present invention. FIG. 5A is an exemplary illustration of a prefabricated modular panel used as a wall, placed within a foundation, and FIG. 5B is an enlarged illustration of the method of the prefabricated modular wall panel within the foundation. FIG. 5C is an exemplary illustration of connection of one or more prefabricated modular panels together to form a housing or chamber in accordance with the present invention, and FIG. 5D is an exemplary illustration of details of one of the corners of the housing or chamber illustrated in FIG. 5C. As illustrated in FIGS. 5A to 5D, one or more prefabricated modular panels 100 are positioned within a foundation 502 of the structure 504, vertically juxtaposed and coupled with one another with wiring 516. The one or more prefabricated modular panels 100 are vertically juxtaposed within a foundation 502 by excavating a channel with desired dimensions, and modifying the prefabricated modular panel 100 by partially removing the filler material 104 thereof at a lower section 506 of the prefabricated modular panel 100 to expose the lattices 102. Thereafter, inserting the modified prefabricated modular panel 100 with the exposed lattices 102 inside the ditch, and coupling the vertically juxtaposed modified prefabricated modular panel by wiring 516 that spans a surface area ° fall juxtaposed panels, including inside the ditches. The wiring 516 (which could be a simple "chicken wire") is coupled with the first and the second elongated members 110 and 112 (through in between the spacing 402 and 404) of the prefabricated modular panels 100. The coupling of the wire 516 with the panels 100 may be done by a variety of fastener mechanism. Thereafter, pouring concrete 514 within the ditches and through the spaces 402 and 404, with the concrete curing and coupling the modified prefabricated modular panel, forming a single piece unitary structure. The prefabricated modular panels may finally be covered with external covering, such as stucco. As best illustrated in FIGS. 5C and 5D, elongated rebar or metal beams 520 and 522 may be used at the corners 512 of the structure 504 to create a multi-story building, with the rebar or metal beams 520 and 522 filled with concrete 514.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, any type of material may be used for the manufacture of the lattices, including thickness. Further, any individual panel may comprise of different types of lattices, non-limiting, non-exhaustive listing of variations may including lattice material, shape, and thickness. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A method for forming a panel comprising:

a) placing at least two lattices in a mold so the lattices are parallel to each other and spaced apart, wherein each lattice comprises
   (i) first and second elongated members spaced apart from each other and parallel to each other, the first and second members forming an axial length of the lattice; and
   (ii) a third member coupled to the first and second members;

b) placing expandable filler material in the mold between the lattices;

c) expanding the expandable filler material to solidify the filler material for maintaining and holding the lattices in the fixed parallel relationship, wherein the lattices are coupled together by the filler material; and d) removing the formed panel from the mold, wherein the lattices in the removed panel are coupled together solely by the filler material.

2. The method of claim 1 wherein placing comprises placing more than two lattices in the mold.

3. The method of claim 1 comprising, before (c), pre-expanding the filler material before placing it in the mold.

4. The method of claim 1 comprising, before (a), forming each lattice by:

i) juxtaposing the first and second elongated members in parallel; and ii) coupling the third elongated member to the first and second members at vertices.

5. The method of claim 4 wherein the first and second elongated members are continuous and the third member is continuous through the vertices.

6. The method of claim 1 wherein the third member is a single piece elongated member having a zigzag configuration that spans longitudinally along the axial length of the lattice and alternately coupled to the first and second member at vertices.

7. The method of claim 1 wherein placing expandable filler material in the mold comprises:

(i) pre-expanding the filler material;

(ii) drying the expanded filler material;

(iii) storing the dried and expanded filler material within storage facilities; and (iv) transferring the pre-expanded filler material into the mold.

8. The method of claim 7 wherein expanding comprises applying heat to the mold to expand the filler material and fill in void spaces within the mold.

9. The method of claim 1 wherein removing comprises cooling the mold for removal of panel, and ejecting the formed panel.

10. The method of claim 1 wherein the mold is comprised of parallel channels that extend longitudinally, oriented along an axial length of the mold, and the step of placing comprises placing each lattice within a channel of the mold, with the channels allowing one of the first and second elongated members of the lattices to be secured in the channels.

11. The method of claim 7 wherein pre-expanding the filler material includes soaking the filler material within an expansion substance and the filler material.

12. The method of claim 11 wherein the expansion substance is pentane.

13. The method of claim 11 wherein drying the expanded filler material includes removing and drying the soaked and expanded filler material by application of dry air.

14. The method of claim 7 wherein storing the dried and expanded filler material within storage facilities includes transporting the dried and expanded filler material by blowers for storage and maturing within silos.

15. The method of claim 1 wherein the removed formed panel has a portion of the third members embedded in the expanded filler material.

16. The method of claim 10 wherein the mold comprises two sections, wherein said channels are formed on at least one of said sections, wherein removing the formed panel from the mold comprises separating the two sections of the mold.

17. A panel formed by the method of claim 1.

18. A method for forming a panel comprising the steps of:

a) selecting a mold having parallel channels that extend longitudinally, oriented along an axial length of the mold;

b) selecting at least two lattices comprising (i) first and second elongated members spaced apart from each other and parallel to each other, the first and second members forming an axial length of the lattice; and (ii) a third member coupled to the first and second members, wherein the third member is a single piece elongated member having a zigzag configuration that spans longitudinally along the axial length of the lattice and alternately coupled to the first and second member at vertices, c) placing each selected lattice within a channel of the mold, with the channels allowing one of the first and second elongated members of the lattices to be secured in the channels so the lattices are parallel to each other and spaced apart;

d) pre-expanding filler material;

e) placing the pre-expanded filler material in the mold between the lattices;

f) solidifying the filler material for maintaining and holding the lattices in the fixed parallel relationship; and g) removing the formed panel from the mold, wherein the removed formed panel has a portion of the third members embedded in the expanded filler material, wherein the lattices in the formed panel are coupled together solely by the solidified filler material.

19. A panel formed by the method of claim 18.

20. The method of claim 18 wherein solidifying comprising heating the filler material.

21. The method of claim 18 wherein the mold comprises two sections, wherein said channels are formed on at least one of said sections, wherein the method further comprises bringing the two sections together after the lattices are placed within the channels and before placing the pre-expanded filler material in the mold to form said mold.

22. The method of claim 18 wherein the mold comprises two sections, wherein said channels are formed on at least one of said sections, wherein removing the formed panel from the mold comprises separating the two sections of the mold.

23. The method of claim 18 wherein the mold comprises two sections, wherein said channels are formed on at least one of said sections, wherein the method further comprises bringing the two sections together after the lattices are placed within the channels and before placing the expandable filler material in the mold to form said mold.

* * * * *

UNITED STATES PATENT AND TRADEMARK OFFICE

CERTIFICATE OF CORRECTION

PATENT NO. : 8,343,398 B2
APPLICATION NO. : 12/895704
DATED : January 1, 2013
INVENTOR(S) : Khatchik Chris Khatchikian It is certified that error appears in the above-identified patent and that said Letters Patent is hereby corrected as shown below:

In the Drawings

| | |
|---|---|
| FIG. 2A, Sheet 6 of 21 | Delete Drawing Sheet 6 and substitute therefore the Drawing Sheet consisting of FIG. 2A, as shown on the attached page.<br><br>Delete "PRE-EXAPNSION"<br><br>Insert -- PRE-EXPANSION -- |
| FIG. 2B, Sheet 7 of 21 | Delete Drawing Sheet 7 and substitute therefore the Drawing Sheet consisting of FIG. 2B, as shown on the attached page.<br><br>Delete "TRANSFERING"<br><br>Insert -- TRANSFERRING -- |

In the Claims

| | |
|---|---|
| Column 11, Claim 18, line 18 | Delete "the steps of" |
| Column 12, Claim 20, lines 15, 16 | Delete "comprising"<br>Insert -- comprises -- |

Signed and Sealed this
Third Day of June, 2014

Michelle K. Lee

Michelle K. Lee
*Deputy Director of the United States Patent and Trademark Office*